US010654040B2

(12) United States Patent
Khalilabad et al.

(10) Patent No.: US 10,654,040 B2
(45) Date of Patent: May 19, 2020

(54) PLATFORM FOR LIQUID DROPLET FORMATION AND ISOLATION

(71) Applicant: Northeastern University, Boston, MA (US)

(72) Inventors: Pooyan Tirandazi Khalilabad, Jamaica Plain, MA (US); Carlos H. Hidrovo Chaves, Boston, MA (US)

(73) Assignee: Northeastern University, Boston, MA (US)

( * ) Notice: Subject to any disclaimer, the term of this patent is extended or adjusted under 35 U.S.C. 154(b) by 294 days.

(21) Appl. No.: 15/680,659

(22) Filed: Aug. 18, 2017

(65) Prior Publication Data

US 2018/0071739 A1 Mar. 15, 2018

Related U.S. Application Data

(60) Provisional application No. 62/376,599, filed on Aug. 18, 2016.

(51) Int. Cl.
*B01L 3/00* (2006.01)

(52) U.S. Cl.
CPC ... *B01L 3/502784* (2013.01); *B01L 3/502723* (2013.01); *B01L 3/502753* (2013.01);
(Continued)

(58) Field of Classification Search
CPC ..... B01L 3/502784; B01L 3/502753; B01L 3/502723; B01L 2400/086;
(Continued)

(56) References Cited

U.S. PATENT DOCUMENTS 4,917,830 A 4/1990 Ortiz et al.
6,116,516 A 9/2000 Ganan-Calvo
(Continued)

FOREIGN PATENT DOCUMENTS

WO WO 2002/068104 A1 9/2002
WO WO 2014/047236 A3 3/2014
WO WO 2015/066115 A1 5/2015

OTHER PUBLICATIONS

Amstad, et al., "Production of amorphous nanoparticles by supersonic spray-drying with a microfluidic nebulator", *Science*, vol. 349, No. 6251, pp. 956-960, 2015.
(Continued)

*Primary Examiner* — Lore R Jarrett
(74) *Attorney, Agent, or Firm* — Hamilton, Brook, Smith & Reynolds, P.C.

(57) ABSTRACT

Embodiments are directed to a platform for liquid droplet generation and isolation for biochemical sensing and testing. An embodiment includes generator, fluid-exchange, and manipulator structures that are vertically aligned on a substrate to form a collection chamber. The generator structure is configured to form liquid droplets from a stream of liquid using gas. The fluid-exchange structure is connected to the generator structure to receive the liquid droplets in a carrier liquid held in the collection chamber. The manipulator structure is connected to receive the liquid droplets in the carrier liquid via an inlet. The manipulator structure defines a manipulator chamber connected to the inlet and has a first outlet and a second outlet and a filter capable of filtering the liquid droplets from the carrier liquid. The first outlet enables removal of the liquid droplets filtered and the second outlet enables removal of the carrier liquid.

21 Claims, 19 Drawing Sheets

(52) U.S. Cl.
CPC ..... *B01L 2200/0673* (2013.01); *B01L 2300/0681* (2013.01); *B01L 2300/0867* (2013.01); *B01L 2300/0887* (2013.01); *B01L 2300/12* (2013.01); *B01L 2400/086* (2013.01)

(58) Field of Classification Search
CPC ..... B01L 2200/0673; B01L 2300/12; B01L 2300/0867; B01L 2300/0681; B01L 2300/0887; B01L 7/525; B01L 3/0241; B01L 2200/12; B01L 2400/049; B01L 2300/0654; B01L 2200/10; B01L 2300/0858; B01L 2300/041; B01L 2400/0622; B01L 2400/0487; B01L 2400/0478; B01L 2300/1822; B01L 2300/0819; B01L 2300/0816; B01L 2200/0689; B01L 7/52; B01L 3/502715; C12Q 1/686; B01F 13/0062; B01F 2215/0037; B01F 2003/0842; B01F 2003/0834; B01F 15/00922; B01F 3/0807; Y02A 90/26; B29L 2031/752; B29C 2045/0079; B29C 45/006; B29C 45/0053; G01N 2021/6439; G01N 21/49; G01N 21/6486; G01N 21/6428; G01N 21/3563
See application file for complete search history.

(56) References Cited

U.S. PATENT DOCUMENTS

| | | | | |
|---|---|---|---|---|
| 6,119,953 | A | 9/2000 | Ganan-Calvo et al. | |
| 6,196,525 | B1 | 3/2001 | Ganan-Calvo | |
| 6,357,670 | B2 | 3/2002 | Ganan-Calvo | |
| 6,554,202 | B2 | 4/2003 | Ganan-Calvo | |
| 6,557,834 | B2 | 5/2003 | Ganan-Calvo | |
| 6,595,202 | B2 | 7/2003 | Ganan-Calvo | |
| 7,708,949 | B2 | 5/2010 | Stone et al. | |
| 7,776,927 | B2 | 8/2010 | Chu et al. | |
| 8,741,192 | B2 | 6/2014 | Torii et al. | |
| 8,968,659 | B2 * | 3/2015 | Davies | B01F 5/0057 422/50 |
| 9,036,144 | B2 | 5/2015 | Lee et al. | |
| 9,134,248 | B2 | 9/2015 | Meinhart et al. | |
| 9,498,759 | B2 * | 11/2016 | Griffiths | G01N 15/14 |
| 9,719,930 | B2 | 8/2017 | Meinhart et al. | |
| 2004/0022939 | A1 | 2/2004 | Kim et al. | |
| 2010/0173394 | A1 * | 7/2010 | Colston, Jr. | B01F 3/0807 435/287.2 |
| 2010/0285975 | A1 * | 11/2010 | Mathies | B01F 3/0807 506/7 |
| 2011/0244455 | A1 * | 10/2011 | Larson | C12Q 1/6816 435/6.11 |
| 2016/0136888 | A1 * | 5/2016 | Bayley | B29C 67/0059 424/450 |

OTHER PUBLICATIONS

Amstad, et al., "The microfluidic nebulator: Production of sub-micrometer sized airborne drops", *Lab Chip*, DOI: 10.1039/C6LC01455K, 21 pages, Mar. 2017.
Anna, et al., "Formation of dispersions using 'flow focusing' in microchannels", *App. Phys. Lett.*, vol. 82, No. 3, p. 364-366, 2003.
Carroll, et al., "Droplet collision mixing diagnostics using single flurophore LIF", *Exp. Fluids*, pp. 1301-1316, 2012.
Carroll, et al., "Droplet Detachment Mechanism in a High-Speed Gaseous Microflow", *Journal of Fluids Engineering*, vol. 135, pp. 071206-1-071206-8, 2013.
Carroll, et al., "Experimental Investigation of Inertial Mixing in Colliding Droplets", *Heat Transfer Engineering*, vol. 34, Nos. 2-3, pp. 120-130, 2013.
Cheah, et al., "Water Slug Formation and Motion in Gas Flow Channels: The Effects of Geometry, Surface Wettability, and Gravity", *American Chemical Society Publications*, pp. 9918-9934, 2013.
Cheah, et al., "Water Slug to Drop and Film Transitions in Gas-Flow Channels", *American Chemical Society Publications*, pp. 15122-15136, 2013.
Ganan-Calvo, "Generation of Steady Liquid Microthreads and Micron-Sized Monodisperse Sprays in Gas Streams", *Phys. Rev. Lett.*, vol. 80, No. 2, pp. 285-288, 1998.
Garstecki, et al., "Formation of bubbles and droplets in microfluidic systems", *Bull. Polish Acad. Sci.*, vol. 53, No. 4, pp. 361-372, 2005.
Haliburton, et al., "Efficient extraction of oil from droplet microfluidic emulsions", *Biomicrofluidics*, vol. 11, No. 3, pp. 34111-1 to 34111-7, 2017.
Jiang, et al., "Microfluidic generation of uniform water droplets using gas as the continuous phase", *J Colloid Interface Sci.*, vol. 448, pp. 275-279, 2015.
Kim, et al., "High-Efficiency and High-Throughput On-Chip Exchange of the Continuous Phase in Droplet Microfluidic Systems", *SLAS Technol.*, pp. 1-7, 2017.
Paust, et al., "Capillary-driven pumping for passive degassing and fuel supply in direct methanol fuel cells", *Microfluid Nanofluid*, 7, pp. 531-543, 2009.
Piorek, et al, "Discrete free-surface millifluidics for rapid capture and analysis of airborne molecules using surface-enhanced Raman spectroscopy", *Anal. Chem.*, vol. 86, pp. 1061-1066, 2014.
Schuler, et al., "Digital droplet PCR on disk", *Lab Chip*, 16, pp. 208-216.
Shahriari, et al., "Flow regime mapping of high inertial gas-liquid droplet microflows in flow-focusing geometries", *Microfluid Nanofluidics*, vol. 20, p. 1-13, 2016.
Tirandazi, et al., "Liquid-in-gas droplet microfluidics; experimental characterization of droplet morphology, generation frequency, and monodispersity in a flow-focusing microfluidic device", *J. Micromech. Microeng.*, 10 pages, 2017.
Litterst, et al., "Increasing μDMFC efficiency by passive CO2 bubble removal and discontinuous operation", *J Micromechanics Microengineering*, 16, pp. 248-253, 2006.

* cited by examiner

PLATFORM FOR LIQUID DROPLET FORMATION AND ISOLATION

RELATED APPLICATION

This application claims the benefit of U.S. Provisional Application No. 62/376,599, filed on Aug. 18, 2016, the contents of which are incorporated herein by reference.

GOVERNMENT SUPPORT

This invention was made with government support under Grant No. CBET-1151091 awarded by the National Science Foundation CAREER program and under Grant No. 1522841 awarded by the National Science Foundation CAREER program. The government has certain rights in the invention.

BACKGROUND

Biochemical sensing and testing is widespread and increasingly relied upon for applications that require quick and accurate results. Existing techniques often perform testing upon liquids in droplet form.

SUMMARY OF THE INVENTION

Biochemical sensing and testing methods can benefit from improvements to generate liquid droplets quickly and precisely. Embodiments of the present invention provide such improvements with an integrated structure that generates and isolates liquid droplets.

Embodiments of the present invention generally relate to the field of droplet microflows and, more particularly, to the integration of a flow controlled liquid-in-gas droplet generator structure, an on-chip droplet collection structure, and a droplet manipulation and harvesting structure in a multilayer and hybrid Polydimethylsiloxane (PDMS) glass microfluidic device.

An embodiment of the present invention is directed to a platform for liquid droplet formation and isolation that can be used in procedures and systems for biochemical sensing and testing. Such a platform includes a generator structure, a fluid-exchange structure, and a manipulator structure that each define a respective portion of a collection chamber. The generator, fluid-exchange, and manipulator structures are vertically aligned on a substrate to form the collection chamber. The generator structure is configured to (1) form liquid droplets from a stream of liquid received at an inlet of the generator and (2) provide the liquid droplets to the fluid-exchange structure. The fluid-exchange structure is connected to the generator structure to receive the liquid droplets in a carrier liquid held in the collection chamber. The liquid-exchange structure is also coupled to the manipulator structure to provide the carrier liquid with the liquid droplets via a fluid-exchange outlet. The manipulator structure is connected to the fluid-exchange outlet to receive the liquid droplets in the carrier liquid via a manipulator inlet. The manipulator structure defines a manipulator chamber that is connected to the manipulator inlet to receive the liquid droplets in the carrier liquid, and the manipulator chamber includes a filter capable of filtering the liquid droplets from the carrier liquid. The manipulator chamber includes a first and a second outlet that enable removal of the liquid droplets filtered from the carrier liquid and the removal of the carrier liquid filtered. The platform generates, collects, and provides liquid droplets for biochemical sensing through the unique generator, fluid-exchange, and manipulator structures.

The generator structure generates the liquid droplets through unique structures defined by the generator structure. In an example embodiment, the generator structure defines a middle liquid channel arranged to allow the stream of liquid to flow into the generator structure and, likewise, defines a first and a second gas channel each on a respective side of the middle liquid channel. The middle liquid channel and the first and second gas channels converge at a junction, within the generator structure, that enables the generator structure to form the liquid droplets by dripping. The dripping results from convergence of the stream of liquid from the middle liquid channel and gas streams from the first and second gas channels. Through this droplet formation technique, the droplets form and detach at the location of liquid injection. In one such embodiment, a steady dripping regime is utilized. According to an embodiment, the dripping occurs at the junction where the middle liquid channel and the first and second gas channels converge. Embodiments may utilize any suitable gas for the generation of liquid droplets. For instance, in an embodiment, the gas streams are air streams.

In contrast to generating droplets via a dripping regime, in an alternative embodiment, the stream of liquid enters the middle liquid channel as a jetted liquid stream. In such a configuration, a diameter of the liquid droplets formed by the generator structure is approximately the same as a diameter of the jetted liquid stream. Further, in another embodiment, the middle liquid channel of the generator structure has a smaller height dimension than height dimensions of both the first and second gas channels so as to enable surrounding the stream of liquid with gas from the first and second gas channels.

In yet another embodiment, the generator structure is composed of (i) a PDMS layer that defines the middle liquid channel and first and second gas channels on each side of the middle liquid channel and (ii) a glass slide bonded to the PDMS layer to form a confined microchannel layout.

As described herein, the generator structure, fluid-exchange structure, and manipulator structure may be part of a platform. According to an embodiment, the generator structure, fluid-exchange structure, and manipulator structure form an integrated platform on a substrate. In an embodiment, the integrated platform includes a glass slide bonded to a bottom surface of the generator structure, and the manipulator structure is disposed on the substrate. Further, a bottom surface of the glass slide is bonded to a top surface of the manipulator structure, and a bottom surface of the fluid-exchange structure is bonded to a top surface of the generator structure.

In an embodiment, the carrier liquid is immiscible. For example, in one embodiment, the carrier liquid is oil. The platform may also have structural elements for the venting of the gas. For example, in an embodiment, a wall of the fluid-exchange structure defines a gas venting outlet at a portion of the collection chamber.

The manipulator chamber of the manipulator structure, according to an implementation, includes one or more columns between a top interior surface of the manipulator chamber and a bottom interior surface of the manipulator chamber. Further, in the same or another embodiment, the manipulator chamber defines first and second side channels that connect to the first outlet. These side channels can be configured to enable the removal of liquid droplets from the manipulator chamber. Moreover, the first and second outlets of the manipulator structure may be configured to accept respective syringes for collecting the liquid droplets filtered from the carrier liquid and the carrier fluid filtered.

Another embodiment of the present invention is directed to an apparatus for liquid droplet formation and isolation. Such an apparatus includes a means for forming liquid droplets from a stream of liquid. The apparatus also includes a means (1) for receiving the liquid droplets from the means for forming the liquid droplets and (2) for storing the liquid droplets in a carrier liquid. Further, the apparatus includes a means for receiving the liquid droplets in the carrier liquid and for filtering and enabling removal of the liquid droplets filtered from the carrier liquid and for enabling removal of the carrier liquid filtered.

The means for forming the liquid droplets defines (i) a middle liquid channel arranged to allow the stream of liquid to flow into the means for forming liquid droplets and (ii) a first and a second gas channel each on a respective side of the middle liquid channel, wherein the middle liquid channel and the first and second gas channels converge at a junction within the means for forming the liquid droplets. In an embodiment, the middle liquid channel has a smaller height dimension than height dimensions of both the first and second gas channels to enable surrounding the stream of liquid with gas from the first and second gas channels. Moreover, the apparatus may be a platform, where the means for forming liquid droplets, the means for receiving the liquid droplets, and the means for receiving the liquid droplets in the carrier liquid form an integrated platform on a substrate.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

The teachings of all patents, published applications, and references cited herein are incorporated by reference in their entirety.

Embodiments provide microfluidic structures for the generation, collection, and processing (i.e., isolation) of uniform micron-size liquid droplets created in a gaseous stream. In an embodiment, such functionality is provided by a microfluidic platform that includes three major structures: (1) a generator structure, (2) a fluid-exchange structure, i.e., collection structure, and (3) a manipulator structure. Briefly, in such an embodiment, monodisperse (i.e., uniform) liquid droplets are generated in a high-speed gas stream and travel within the gaseous carrier fluid inside the generator structure. The airborne droplets are then transitioned into, and collected within, an immiscible liquid in the fluid-exchange structure. Thus, embodiments provide functionality for the non-destructive exchange of a continuous flow of droplets from a gaseous phase into a liquid phase. The droplets transition from a confined channel of the generator structure into an open-air collection structure in one embodiment. After collection in the fluid-exchange structure, droplets are then transferred into the manipulator structure for processing and harvesting. Thus, the platform provides functionality for the non-destructive extraction of droplets from an open-air collection structure into the confined microchannels of the manipulator structure.

In one embodiment, it can be said that five major operations occur in the microfluidic processing implemented via the platform. Specifically, these operations include: (1) generation, (2) transition, (3) collection, (4) extraction, and (5) harvesting. According to an embodiment, these operations occur pneumatically and hydraulically without the use of external electrical or magnetic fields or forces. Such functionality relies solely on the geometry of the platform and the flow conditions.

Because of the aforementioned functionality, embodiments of the system are useful for biochemical testing and sensing. For instance, embodiments can be used for the investigation and sensing of airborne analytes and threats by ad/absorption of the analytes into the liquid microdroplets and subsequent interrogation of the digital droplets using different analytical techniques.

Figure 1:
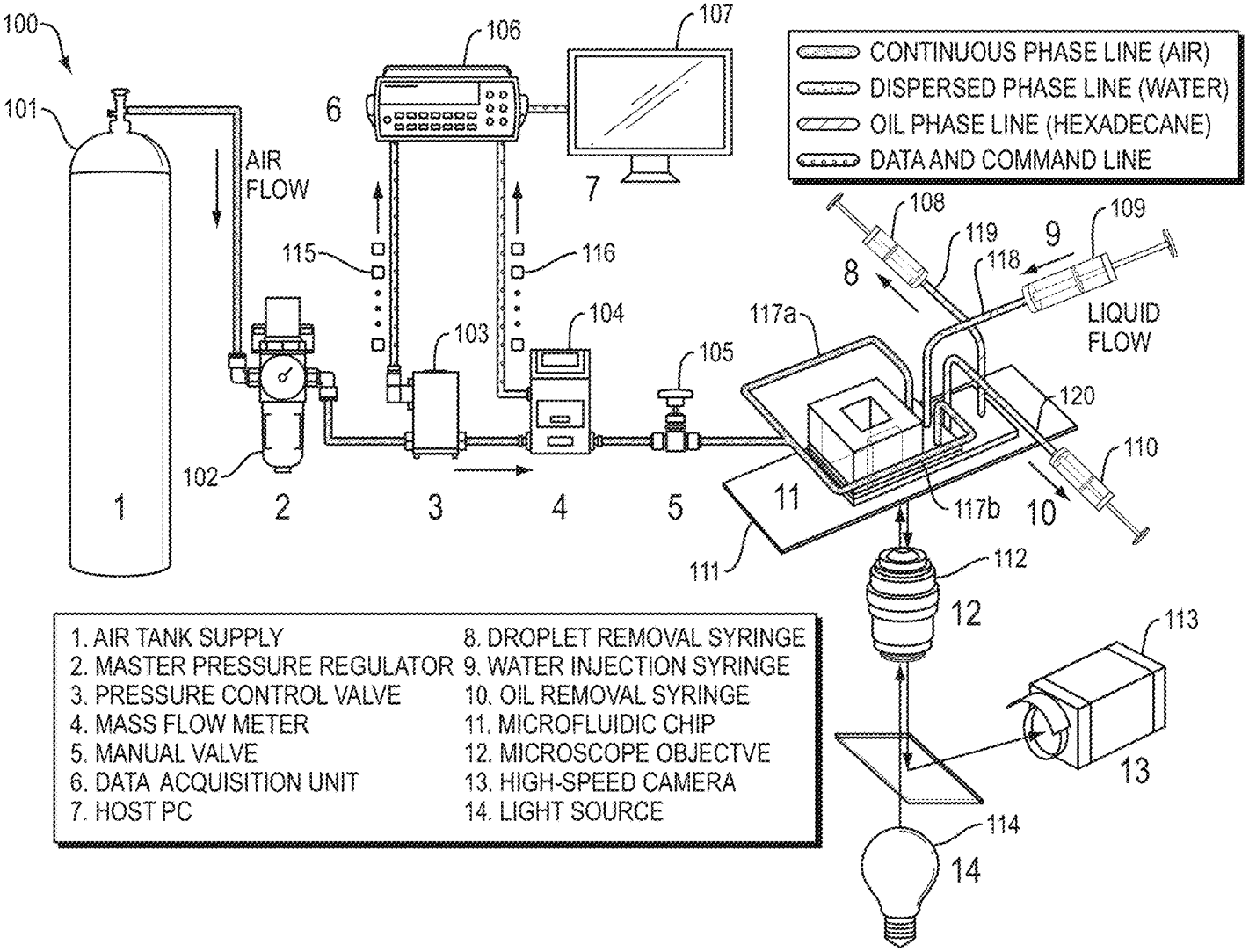
FIG. 1 is a diagram that depicts a system that employs a platform according to an embodiment for liquid droplet generation and isolation.

FIG. 1 depicts an example system 100 in which a microfluidic platform 111 may be employed for generation and isolation of liquid droplets for biochemical testing and sensing. The system 100 includes an air supply tank 101 which is coupled to a pressure regulator 102. The pressure regulator 102 is connected to a pressure control valve 103 that connects to both a flow meter 104 and a data acquisition unit 106. The data acquisition unit 106 connects to a host computer 107 and, like the pressure control valve 103, also connects to the mass flow meter 104. The mass flow meter 104 connects to a manual valve 105, which, in turn, is coupled to the platform 111 to supply gas to the platform 111.

In the system 100, gas from the supply tank 101 passes through the pressure regulator 102, which serves to control the air pressure in the system 100. The gas continues from the pressure regulator 102 to the pressure control valve 103, which likewise controls the gas pressure in the system. The pressure control valve 103 also provides pressure data 115 to the data acquisition unit 106, and the data acquisition unit 106 provides the data 115 to the host computer 107.

The gas continues downstream from the pressure control valve 103 to the mass flow meter 104. The mass flow meter 104 measures the mass flow rate of the gas traveling through the flow meter 104 and provides this data 116 to the data acquisition unit 106, which provides the data 116 to the computer 107. From the mass flow meter 104, the gas continues through the manual valve 105, which is the final device between the gas supply 101 and the platform 111. The valve 105 allows the controlled gas to enter the platform 111.

Gas leaves the valve 105 and enters the platform 111 via two inlets 117*a* and 117*b*. Likewise, liquid from an input syringe 109 enters the platform 111 via an inlet 118. As described herein, the structure of the platform 111 results in creation of liquid droplets. The liquid droplets are collected in a carrier fluid (being any appropriate fluid known in the art), and the droplets are filtered from the carrier liquid within the platform 111. These filtered droplets are removed from the platform 111 via an outlet 119 by a syringe 108. Similarly, the carrier fluid having been filtered is removed from the platform 111 via an outlet 120 by a syringe 110. In this way, the system 100 generates liquid droplets that can be used for biochemical sensing and testing. Further detail regarding the creation, collection, and isolation of the liquid droplets performed by the platform 111 is described hereinbelow.

The system 100 in the example embodiment of FIG. 1 also includes a microscope objective lens 112, light source 114, and high-speed camera 113. The lens 112, light source 114, and camera 113 function to capture images of the various stages of droplet formation, collection, and harvesting within the platform 111.

Figure 2:
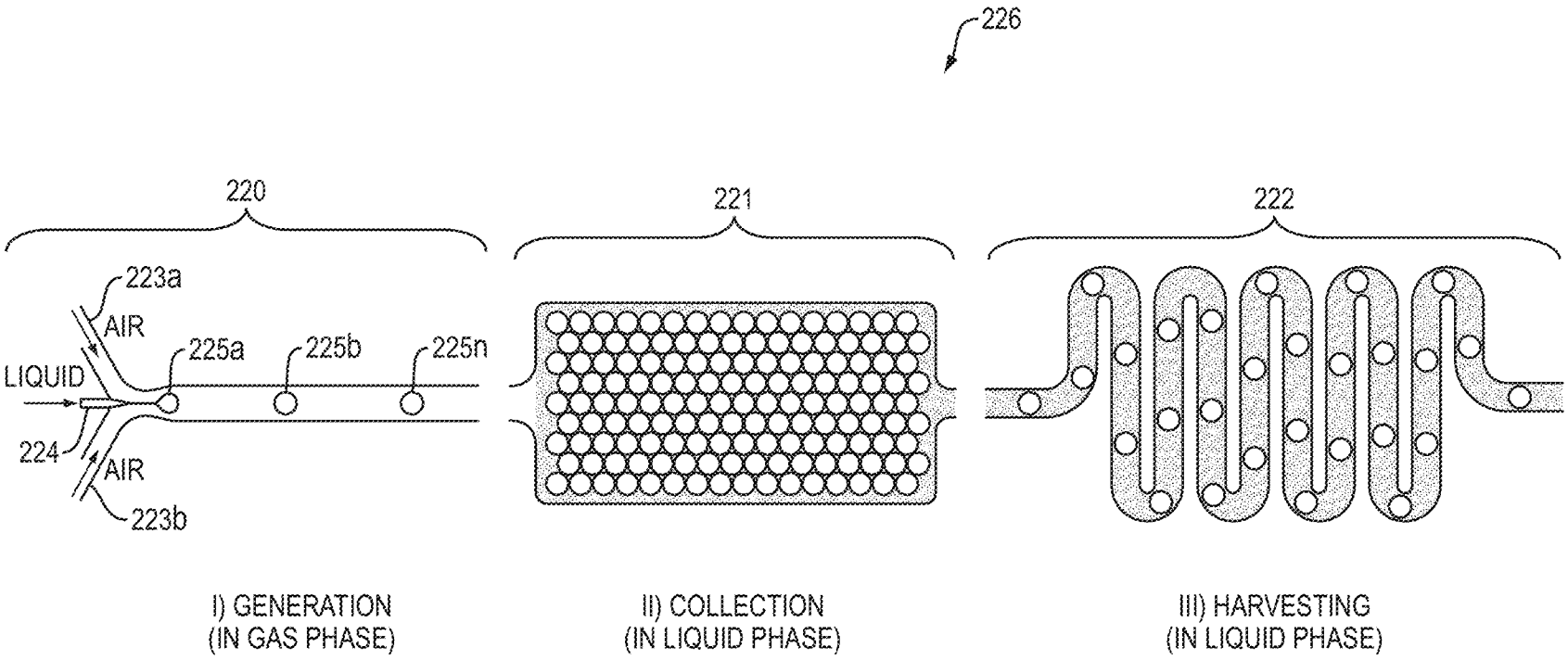
FIG. 2 is a simplified illustration of stages of liquid droplet generation, collection, and harvesting performed by embodiments.

FIG. 2 illustrates a process flow 226 that is implemented by embodiments of the present invention, such as the platform 111. The process flow 226 includes a generation phase 220 where the droplets 225*a-n* are formed within a gaseous medium in a confined planar microchannel (not explicitly shown). At the generation phase 220, gas enters the channels 223*a* and 223*b* and meets liquid from the channel 224 to form the droplets 225*a-n* (generally referenced as 225). The droplets 225 are then carried along the microchannel to the outlet of a generator structure, that defines the channels 223*a-b* and 224, where the droplets 225 are transferred into a carrier liquid in the collection phase 221. After transition into the liquid carrier, during the collection phase 221, the droplets 225 are collected in an on-chip minichamber (i.e., a collection structure). In turn, the collected droplets are transferred from the collection structure into a second series of microchannels for performing desired manipulation processes. During harvesting 222, the droplets 225 are separated from the carrier liquid and processed. As described in further detail herein, the phases 220, 221, and 222 are implemented in separated layers of a platform device, and the foregoing functionality is a result of the geometry and structure of the device.

Embodiments provide numerous advantages and features over existing methods for droplet creation and isolation. Particularly, embodiments utilize a high-speed gas flow and a lab-on-a-chip (LOC) based platform to create microdroplets, e.g., 50 μm-120 μm. The platform may be a multilayer and multipurpose microfluidic device. The functionality, i.e., droplet formation, collection, and isolation, is provided using a structure that implements continuous phase transition from gas to liquid within an integrated microfluidic platform. The structure and resulting droplet formation utilizes passive, flow driven methods for the generation and manipulation of the airborne droplets. Likewise, embodiments utilize a manipulator structure for the removal and manipulation of droplets from an integrated collection minichamber.

Unlike existing methods, embodiments provide chip-based and oil-free droplet and particle generation. Further, embodiments can form 50 μm monodisperse (i.e., uniform) liquid droplets in a gas stream with a 1 kHz generation rate. This functionality is invaluable to a variety of applications, including aerosol drug delivery, digital polymerase chain reaction (PCR), food industry, medical diagnostics, aerobiology, and explosive and chemical detection.

Figure 3B:
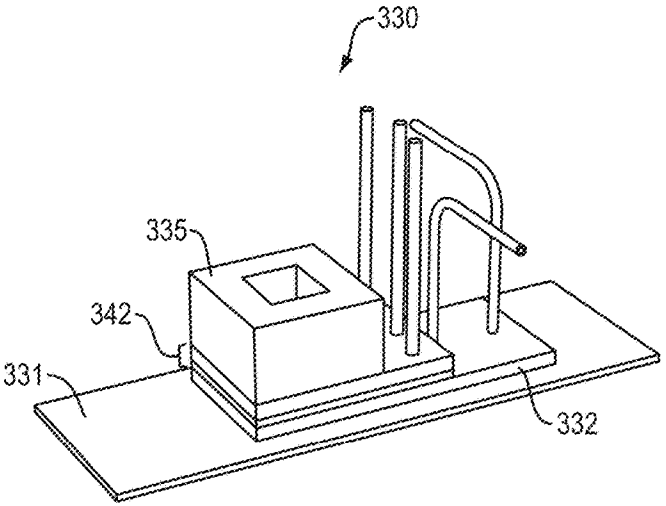
FIG. 3B depicts an integrated platform for liquid droplet formation and isolation according to an embodiment.
Figure 3C:
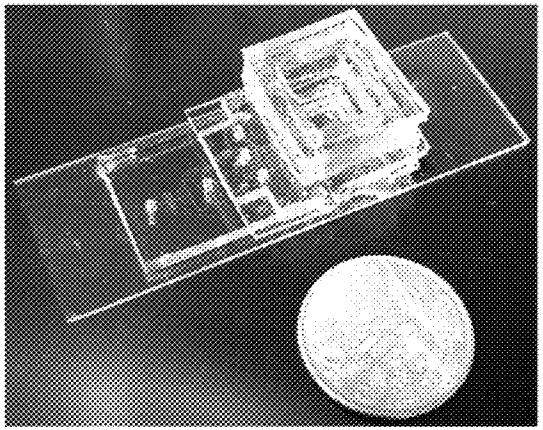
FIG. 3C is a photograph of an embodiment of an integrated platform according to an embodiment.
Figure 3A:
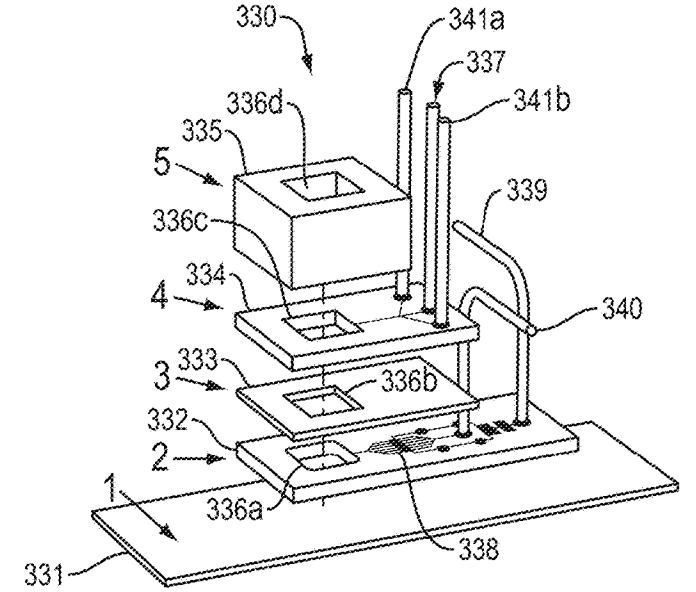
FIG. 3A is an exploded view of a platform according to an embodiment.

FIG. 3A is an illustration of a lab-on-chip platform 330 for the creation, collection, and isolation of liquid droplets according to an embodiment. The lab-on-chip platform 330 is comprised of a substrate layer 331, manipulator structure layer 332, glass layer 333, generator structure layer 334, and fluid-exchange structure layer 335. For convenience, the term "layer" will be dropped going forward as each layer is mentioned in the description immediately below, where appropriate.

The substrate 331 is a substrate on which the other layers (332-335) are stacked to form the platform 330. In the platform 330 a generator structure 342 is formed by the layer 334 and the glass layer 333. The generator structure 342 includes a flow-focusing geometry with a middle liquid channel that meets two side gas channels at a junction, such as the geometry 550 described hereinbelow in relation to FIG. 5. In an embodiment, the generator structure layer 334 (which forms the generator structure 342 with the glass layer 333) is fabricated using a photosensitive epoxy, such as SU-8, and photolithography and soft lithography with PDMS that defines the middle liquid channel and the first and second gas channels on each side of the middle liquid channel. The generator structure layer 334 is bonded to the glass layer 333 to make the confined microchannel layout of the generator structure 342. It is noted that the structures of the platform 330, e.g., the fluid-exchange structure 335, may be constructed from any appropriate material known in the art using any technique, such as micromolding. Moreover, the various layers 335, 334, 333, 332, and 331 may have varying height dimensions and similarly, the channels within the layers may have varying height dimensions. The platform 330 also includes the manipulator structure 332 which similarly to the generator structure layer 334 is fabricated using PDMS. The platform 330 also includes the fluid-exchange structure 335, which, again, can be fabricated using PDMS. While the platform 330 may be a hybrid PDMS-glass microfluidic device, embodiments of the present invention are not so limited and may be fabricated using any appropriate techniques and materials.

FIG. 3B depicts the embodiment of the integrated platform 330 of FIG. 3A with the layers bonded. The integrated platform 330 is constructed by placing the generator structure 342 (formed by the generator structure layer 334 and glass layer 333) on top of the manipulator structure 332. The fluid-exchange structure 335 is placed on top of the stack that includes the layers 334, 333, and 332. The layers 335, 334, 333, and 332 each define a portion, 336*d*, 336*c*, 336*b*, and 336*a*, of a collection chamber (collectively 336) that is formed through vertical alignment of the layers 335, 334, 333, and 332 on the substrate 331.

During use, the platform 330, a picture of which is shown in FIG. 3C, generates liquid droplets (not shown) in the generator structure 342. The droplets then enter the collection chamber 336, which is filled with a carrier liquid, e.g., oil. The fluid-exchange structure 335 leverages the density difference between the droplets and gas that enter the collection chamber 336 to vent the gas via the open-air chamber 336. Because of the density of the droplets, the droplets remain in the carrier liquid in the collection chamber 336. While the fluid exchange structure 335 is depicted with an open chamber 336 to vent gas, embodiments are not limited to such a venting structure. For example, in another embodiment, a wall of the fluid exchange structure 335 may define a gas venting outlet at a portion of the collection chamber 336.

The droplets next pass from the collection chamber 336 to the manipulator structure 332, where the droplets are processed and harvested. This functionality is described in further detail hereinbelow in relation to FIGS. 5 and 6. Thus, the platform 330 is a multilayer structure that allows droplets to travel in different planes within the different phases of a generation and collection process, i.e., generation, collection, and manipulation and harvesting.

The platform 330 comprises three major structures: (1) a generator structure 342 (formed by the generator structure layer 334 and glass layer 333), (2) a fluid-exchange structure 335, and (3) a manipulator structure 332, each defining a respective portion 336*a-d* of the collection chamber 336. The generator structure 342, fluid-exchange structure 335, and manipulator structure 332 are vertically aligned on the substrate 331 to form the collection chamber 336. The generator structure 342 is configured to form liquid droplets from a stream of liquid received at a generator inlet 337 using gas from the inlets 341*a* and 341*b*. The generator structure 342 provides the liquid droplets to the fluid-exchange structure 335. The fluid-exchange structure 335 is connected to the generator structure to receive the liquid droplets in a carrier liquid held in the collection chamber 336. The fluid-exchange structure 335 is also connected to the manipulator structure 332 to provide the carrier liquid with the liquid droplets via a fluid-exchange outlet. The manipulator structure 332 is connected to the fluid-exchange outlet to receive the liquid droplets in the carrier liquid via a manipulator inlet. The manipulator structure 332 defines a manipulator chamber 338 that is connected to the manipulator inlet. The manipulator chamber 338 has a first outlet 339 and a second outlet 340. The defined manipulator chamber 338 includes a filter (not shown) capable of filtering the liquid droplets from the carrier liquid. The first outlet 339 enables removal of the liquid droplets filtered from the carrier liquid and the second outlet 340 enables removal of the carrier liquid filtered.

Figure 4:
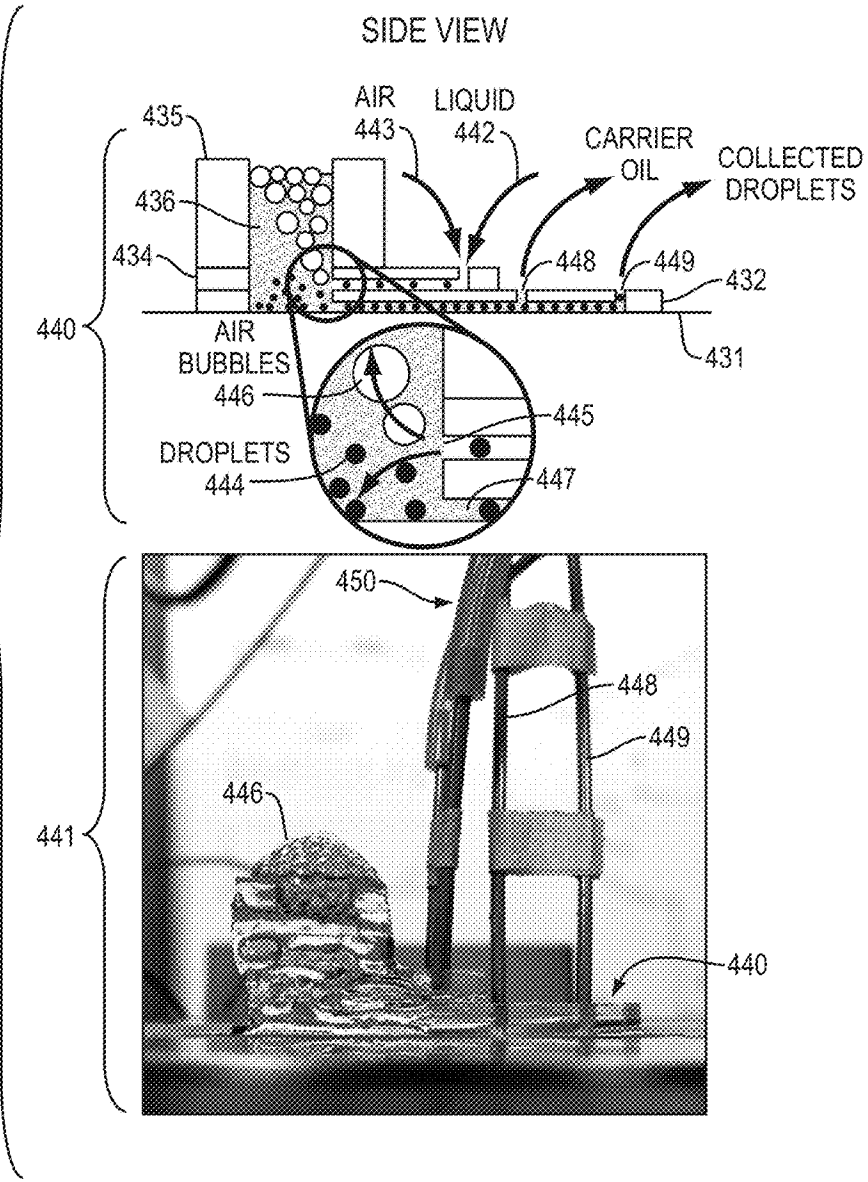
FIG. 4 is a cross-sectional view of a platform according to an embodiment during operation and a photograph of the platform during use.

FIG. 4 illustrates a side view of a platform 440, according to an embodiment, during operation and a picture 441 of the platform 440 during use. Operation of the platform 440 includes flowing the liquid 442 and gas phases 443 in the generator structure 434 to create the liquid droplets 444. The droplet generation process takes place at a flow-focusing junction within the generator structure 434. An outlet 445 of the generator structure 434 is immersed in the collection chamber 436, which is formed through vertical alignment of the fluid exchange structure 435, generator structure 434, and manipulator structure 432. The collection chamber 436 is filled with a carrier liquid, e.g., oil, to a level above the outlet 445 of the generator structure 434 such that the liquid droplets 444 from the generator structure 434 enter the chamber 436 and the carrier liquid in the collection chamber 436.

The gas 443 containing the generated droplets 444 goes directly into the carrier liquid and, further, the gas 443 that enters the collection chamber 436 and leaves the platform 440 in the form of air bubbles 446 through the fluid-exchange structure 435. The liquid droplets 444 transition into the carrier liquid phase in the collection chamber 436 as the droplets 444 flow with the gas phase 443 into the carrier liquid of the chamber 436, where they are collected by sinking and accumulating at the bottom of the collection chamber 436.

Thus, by transferring the airborne liquid droplets 444 into a second liquid medium, it is feasible to manipulate and process the generated droplets in this carrier liquid using microfluidic-based analytical techniques, such as digital droplet PCR (dd-PCR). Droplet extraction and subsequent harvesting take place through the bottom layer, which is the manipulator structure 432. Droplets 444 are harvested from the manipulator structure 432 via the outlet 449, and carrier liquid is harvested from the manipulator structure via the outlet 448.

The picture 441 depicts the platform 440 during operation. In the picture 441, gas and liquid enter the platform 440 via the input channels, generally referenced as 450. As can be seen, air bubbles 446 (which are similar to a foam-type solution) leave the platform 440 through the top of the collection chamber 436. Further, carrier oil is removed from the platform 440 via the outlet 448, and droplets are removed via the outlet 449.

Figure 5:
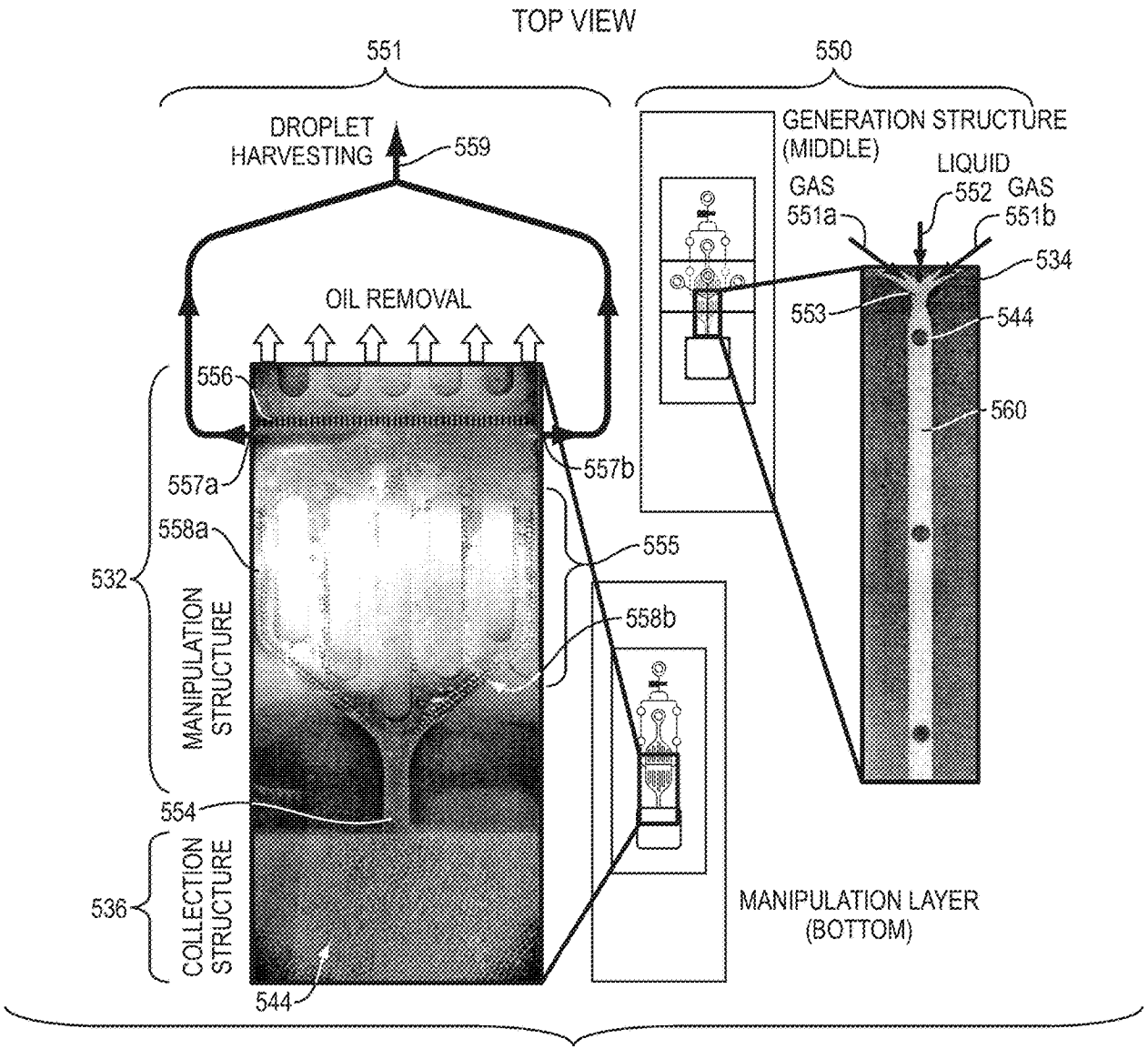
FIG. 5 is a top view of structures used in an embodiment.

FIG. 5 depicts a top view 550 of the generator structure 534. The generator structure 534, which may be constructed using layers (such as the generator structure layer 334 and glass layer 333 described hereinabove in relation to FIG. 3), is configured to create the liquid droplets 544. Specifically, the generator structure 534 defines the middle liquid channel 552 that allows a stream of liquid to flow into the generator structure 534. Likewise, the generator structure 534 defines the gas channels 551*a* and 551*b*, which are each on a respective side of the middle liquid channel 552. The channels 551*a-b* and 552 converge at the junction 553. In operation, gas enters the side channels 551*a* and 551*b*, and liquid enters the middle channel 552.

As mentioned above, the channels 551*a-b* and 552 converge at the junction 553, and this convergence of gas and liquid creates the droplets 544. Specifically, in one embodiment, the generator structure 534 is configured to form the liquid droplets 544 by dripping. This dripping occurs at the junction 553, and results from the convergence of the stream of liquid from the middle liquid channel 552 and gas streams from the gas channels 551*a* and 551*b*. In an embodiment, the droplets are formed through the injection of water as the dispersed phase and air as the continuous phase in the flow-focusing junction 553.

Embodiments can use any variety of gases as the continuous phase for droplet formation. In an embodiment, the gas channels 551*a* and 551*b* and the liquid channel 552 have rectangular cross sections. However, embodiments are not so limited, and the channels 551*a-b* and 552 may have any suitable geometry. Further, for droplet generation using the dripping regime, the liquid and gas may travel in the same plane. Moreover, in an embodiment, the droplets 544 are in contact with a top PDMS layer and a bottom glass layer that form the generator structure 534.

The generator structure 534 can be modified through changes to the junction 553 and outlet 560 to control the size of the droplets 544. Example droplet sizes range from 50 microns to 120 microns in diameter. Further, the droplets 544 can be monodisperse, i.e., uniform. For example, embodiments of the generator structure 534 can create droplets 544 having the same diameter with a coefficient of variance of about 5% to 20%.

Moreover, embodiments of the generator structure 534 can facilitate a species transport from a gaseous sample into high surface-area-to-volume ratio liquid droplets. This transport can be absorption (into the droplet bulk) or adsorption (onto the droplet surface) of gaseous analytes or targets. For instance, in an embodiment, a target, e.g., a gaseous analyte, which is initially present in the gaseous phase is introduced as the continuous gas phase into the generator structure 534. Because of the high surface-area-to-volume ratio of the generated droplets within the gaseous flow, diffusion of the species from the gas into the droplets is facilitated. The species are accumulated in the small volume of each droplet resulting in preconcentration of the sample from its initial gaseous state into individual liquid microreactors. Further, because embodiments generate discrete droplets, a sample can be considered to be digitized, i.e., absorbed and at the same time partitioned and isolated into digital droplets for enhanced detection.

FIG. 5 also depicts a top view 551 of a portion of the manipulator structure 532 and the collection chamber 536. As described, after droplets are generated by the generator structure 534, liquid droplets 544 enter the carrier liquid and collect at the bottom of the collection chamber 536.

The manipulator structure 532 then processes the droplets 544 and enables droplet 544 harvesting. The manipulator structure 532 includes several structures to provide such functionality, namely (i) a manipulator structure inlet 554, (ii) extraction section 555, (iii) microfilter 556, and (iv) harvesting microchannels 557*a* and 557*b*. The carrier liquid and collected droplet mixture enters the manipulator structure 532 via the inlet 554 at the bottom of the chamber 536. In an embodiment, the droplets 544 are gradually slowed upon entering the manipulator structure 532 in the v-shaped expansion 555 and the droplets 544 are packed closely (e.g., the droplet collections 558*a* and 558*b*) in the extraction section 555 of the manipulator structure 532. The v-shaped expansion 555 functions to reduce spacing between the droplets 544. In the extraction section 555 of the manipulator structure 532, two different flows, a main flow and a harvesting flow, are induced by two independently controlled syringes (not shown) that connect to outlets of the manipulator structure 532 (such as the outlets 648 and 649 depicted in FIG. 6). These syringes may have different withdraw flows and thus, can be used to adjust the flow of carrier liquid removal and the flow of droplet removal. In the top view 551 the oil harvesting outlet is not shown and a graphical representation of the flow of droplets from the microchannels 557*a* and 557*b* to the outlet 559 is depicted. The purpose of the droplet and carrier fluid flows is to draw and filter/separate the droplets 544 from the carrier liquid and direct the droplets 544 to the harvesting microchannels 557*a* and 557*b*. As shown, the harvesting microchannels 557*a* and 557*b* are coupled to the outlet 559 to enable harvesting of the droplets 544.

In the platform the amount of carrier liquid present in the collection chamber 536 is much larger than the total volume of liquid droplets 544 created by the generator structure 534. Consequently, the droplets 544 are sparse and not concentrated. As such, the excess oil is removed via an outlet, e.g. the outlet 648 of FIG. 6, and the droplets 544 are transferred from the main extraction section 555 into the harvesting microchannels 557*a* and 557*b* in order to rearrange the droplets 544 as arrays of digital fluid packages (e.g., 558*a* and 558*b*) for further processing. In the manipulator structure 532, an arrangement of microfilter posts 556 are arranged downstream of the extraction section 555. The posts 556 allow the oil to be extracted via an outlet while containing the droplets 544 for harvesting the droplets 544, via the channels 557*a* and 557*b*. The posts 556 can be modified to adjust the ratio of droplet to oil-volume that is in the carrier liquid removed as well as the droplet-to-droplet spacing in the harvested droplets.

Figure 6:
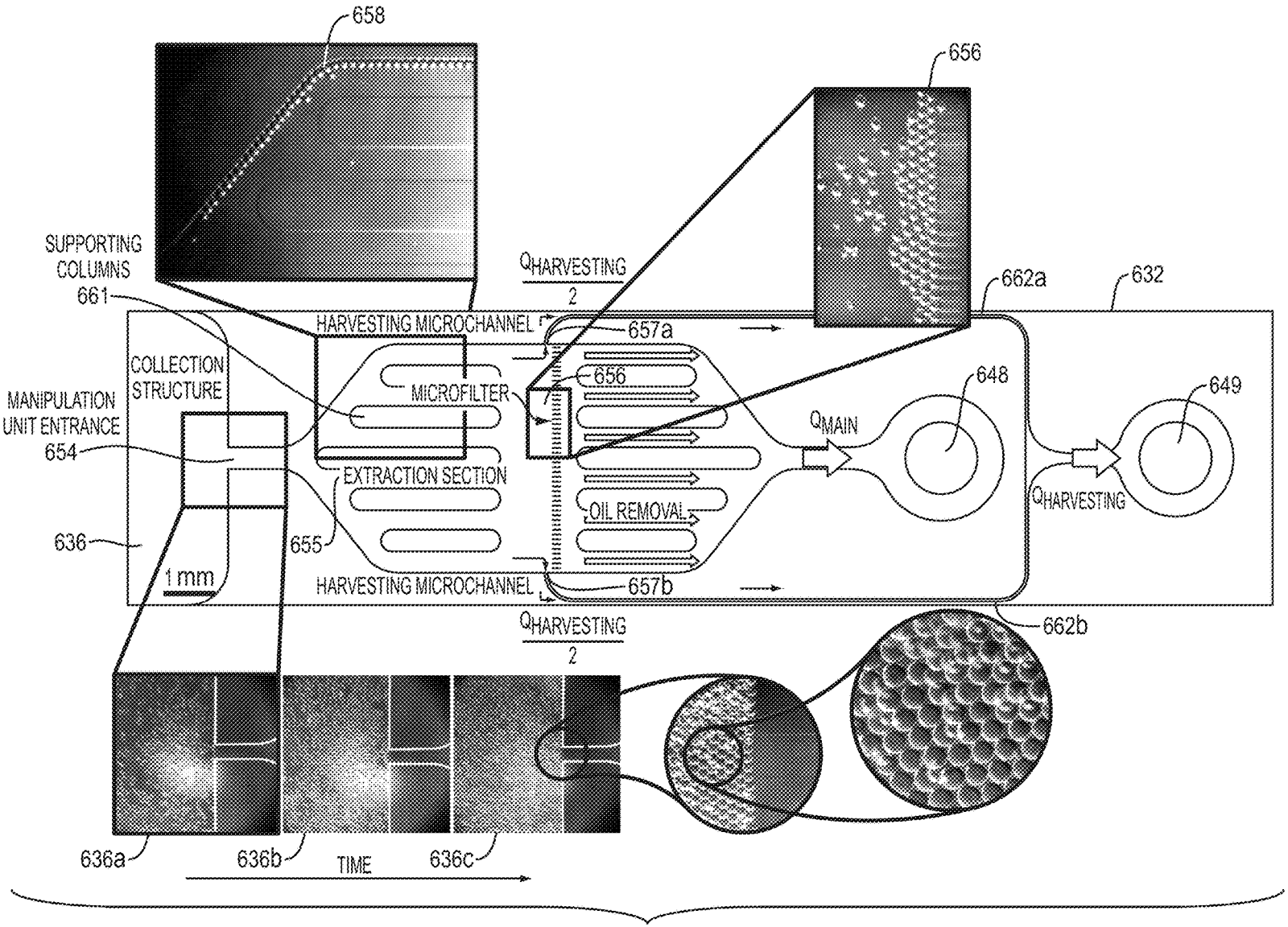
FIG. 6 is a graphical depiction of a structure for liquid droplet harvesting and accompanying photographs of portions thereof during operation.

FIG. 6 is a graphical depiction of an entire manipulator structure 632 according to an embodiment. The manipulator structure 632 has an inlet 654 connected to a collection chamber 636 and a v-shaped extraction section 655 that connects to the inlet 654. The manipulator structure 632 also includes support columns 661. The support columns 661 are between a top interior surface of a manipulation chamber, i.e., the volume inside the manipulator structure 632 that contains droplets and carrier liquid during operation, and a bottom interior surface of the manipulation chamber. The support columns 661 provide structural rigidity to the manipulator structure 632. Further, the manipulator structure 632 defines side microchannels 657*a* and 657*b*. The microchannels 657*a* and 657*b* connect via channels 662*a* and 662*b* (which are defined by the manipulator structure 632) to the outlet 649. The manipulator structure 632 includes a microfilter 656. Downstream from the microfilter 656 is a carrier fluid outlet 648 for the removal of carrier fluid.

During operation of a platform that includes the manipulator structure 632 and the collection chamber 636, droplets (in carrier fluid) collect in the collection chamber 636. The photographs 636*a-c* show the accumulation of the droplets in the collection chamber 636 over time. Droplets and the carrier fluid then enter the manipulator structure 632 via the inlet 654 and because of the v-shaped entrance 655, the droplets line up as shown by the droplet array 658. The droplets and carrier fluid then continue through the manipulator structure 632 and the droplets collect at the filter 656. Once at the filter 656, the droplets are harvested via the microchannels 657*a* and 657*b*. The droplets enter through the channels 657*a* and 657*b* into the routing channels 662*a* and 662*b* and leave the manipulator structure 632 via the outlet 648. Carrier fluid passes through the filter 656 and is removed from the manipulator structure 632 via the outlet 648.

In operation, the flow of droplets and carrier fluid results from the structures of the platform as well as suction flows caused by respective syringes (not shown) that connect to the outlets 648 and 649 for collecting carrier fluid and droplets, respectively. The flow in the manipulator structure 632 includes a main channel flow for removing the carrier fluid via the outlet 648 and a pair of microchannel 657*a* and 657*b* flows for harvesting the droplets from the extraction section 655. Further, as described in further detail below, droplet harvesting can be controlled by modifying the flow conditions in the manipulator structure 632. The modification of flow conditions can be controlled via syringes (not shown) such that a maximum portion of droplets together with a minimum portion of the carrier fluid are directed to the harvesting microchannels 657*a* and 657*b*.

Figure 7:
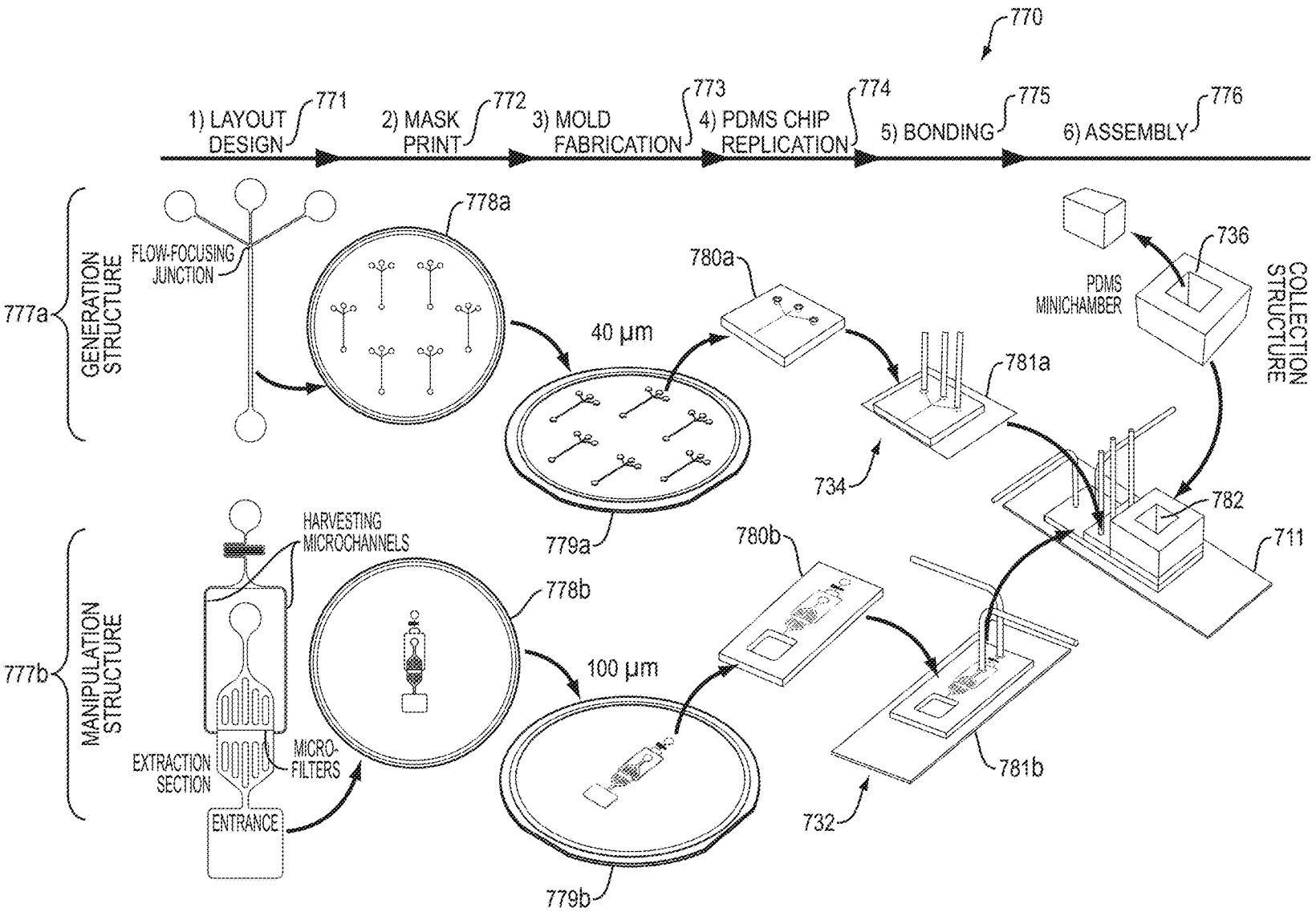
FIG. 7 is a flowchart of a method for manufacturing a platform.

FIG. 7 illustrates a process 770 for fabrication of a structures of a microfluidic platform 711 according to an embodiment. The process 770 begins at 771 with designing a layout 777*a* for a generator structure and a layout 777*b* for a manipulator structure. At 772, designs 777*a* and 777*b* are printed onto transparency masks 778*a* and 778*b*. To continue, at 773, photolithography is used for fabricating a silicon molds 779*a* and 779*b* for the generator structure and manipulator structure, respectively. In turn, at 774, soft lithography molding with PDMS is used, along with cutting and punching, to create a structure 780*a* and a structure 780*b*. Bonding 775 is done next and the structure 780*a* is bonded, using plasma cleaner, to glass 781*a* to form a generator structure 734. Similarly, the structure 780*b* is bonded to the substrate 781*b* to create a manipulator structure 732. At 776, the platform 711 is assembled from the generator structure 734, manipulator structure 732 and a fluid-exchange structure 736. The fluid-exchange structure 736 is constructed from a hollow PDMS slab. During assembly, the fluid-exchange structure 736 is bonded onto the generator structure 734 and manipulator structure 732 with the fluid-exchange structure 736 being the topmost layer. Further, the manipulator structure 732, generator structure 734, and fluid-exchange structure 736 are vertically aligned so as to form the collection chamber 782.

Figure 8:
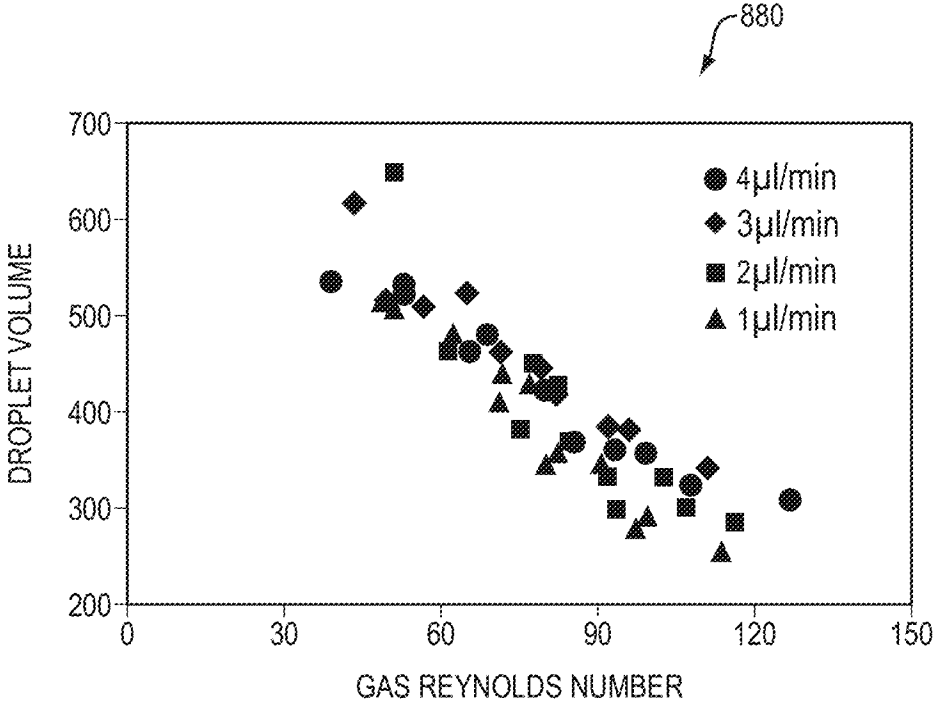
FIG. 8 is a plot showing the volume of droplets generated under varying gas flow rate conditions.

Operation of embodiments can be tuned using varying flow rates to optimize droplet formation and harvesting. For instance, in one such example, experiments were conducted for different flow rates of water (dispersed phase) and air (continuous phase) within a dripping region of a liquid-gas droplet generating structure of an embodiment. In embodiments, droplets are generated within a gaseous medium and are transferred and collected within a second liquid medium (the carrier liquid). In an example experiment, the size distribution of the collected droplets was subsequently analyzed with MATALB using captured images of the collection chamber. FIG. 8 is a plot 880 which shows droplet volume, for a dripping regime generator structure, versus gas Reynolds numbers used for droplet formation performed at various gas, and four liquid flow rates (4 μl/min, 3 μl/min, 2 μl/min, and 1 μl/min). The plot 880 shows that droplet volume, i.e., the volume of a single droplet, decreases considerably as the gas Reynolds number (calculated based on the hydraulic diameter of the outlet of the generator structure) increases. Conversely, changes in droplet volume as a function of the flow rate of the dispersed liquid phase are very small or negligible. Thus, the volume of generated droplets for the dripping regime is mainly dependent on the flow conditions of the continuous gaseous phase in the system.

Figure 9:
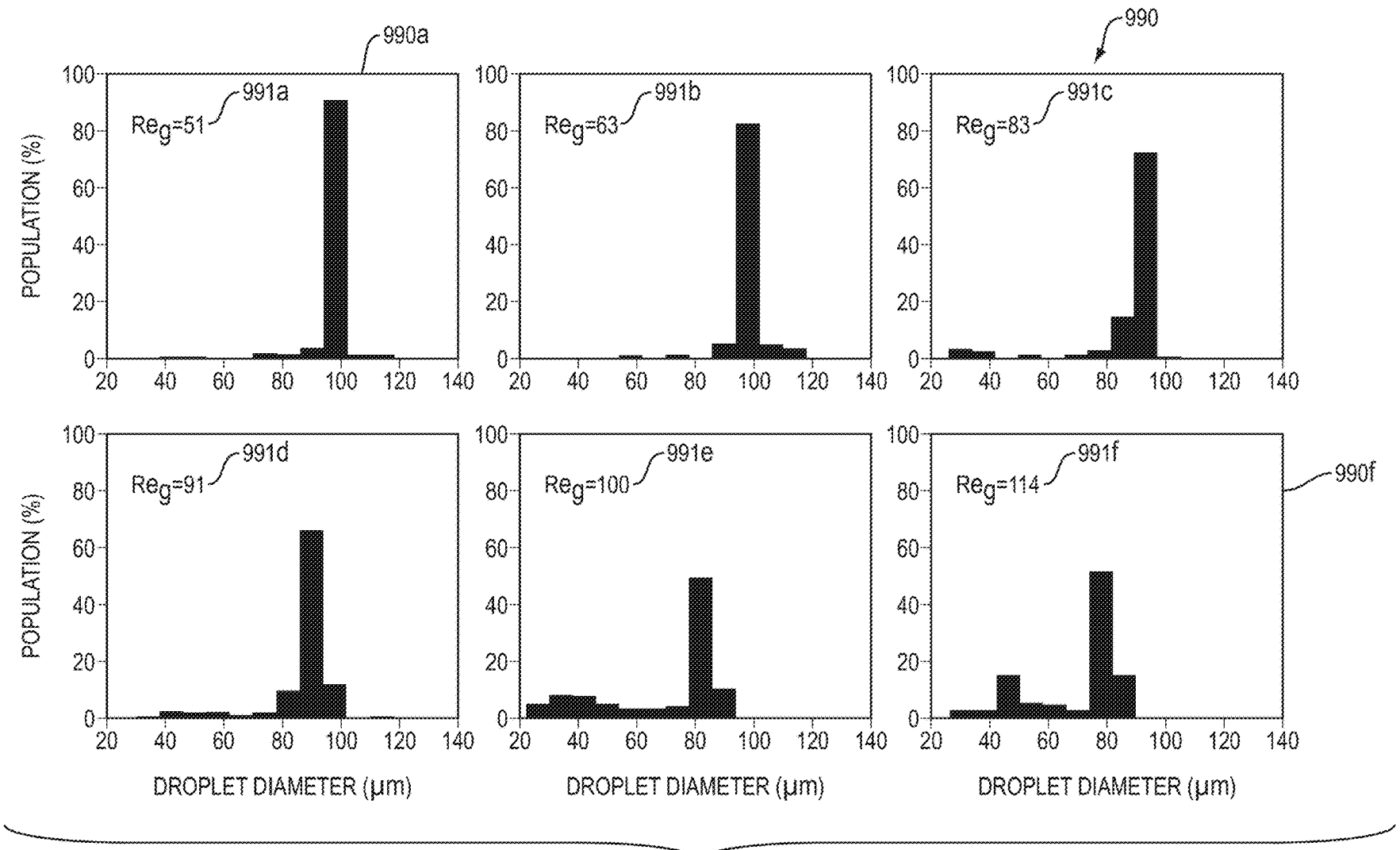
FIG. 9 are plots depicting droplet diameter variation for droplets generated using gases with various gas Reynolds numbers.

FIG. 9 illustrates, in the plots 990, the variation in size of the droplet population for droplets generated using gases with different gas Reynolds numbers 991*a-f* where a liquid flow rate of 1 μl/min is used. The plots 990 show that droplets with a narrow size distribution are generated when the droplets are generated with a gas flow with a lower Reynolds number, e.g., 51, and a wide size distribution of the droplets results when the gas Reynolds number increases, e.g., 114. Droplet distribution can be quantified using a droplet polydispersity index (DPI) defined as σ/d (where σ represents the standard deviation of the droplet diameters and d is the average diameter of the generated droplets. The DPI is less than 5% when the droplets are created using a gas with a low Reynolds number ($Re_g$<60), e.g., the results 990*a*, and DPI is as much as 20% when the droplets are created using gas with a higher Reynolds number ($Re_g$>100), e.g., the results 990*f*. Thus, although increasing the Reynolds number results in smaller size droplets, an increased Reynolds number also increases polydisperse droplet generation. Polydisperse generation may provide droplets that are not suitable for certain applications. For example, the generation of microparticles and microcapsules requires products with very low variations in size and thus, polydisperse droplets would be unsuitable.

Figure 10:
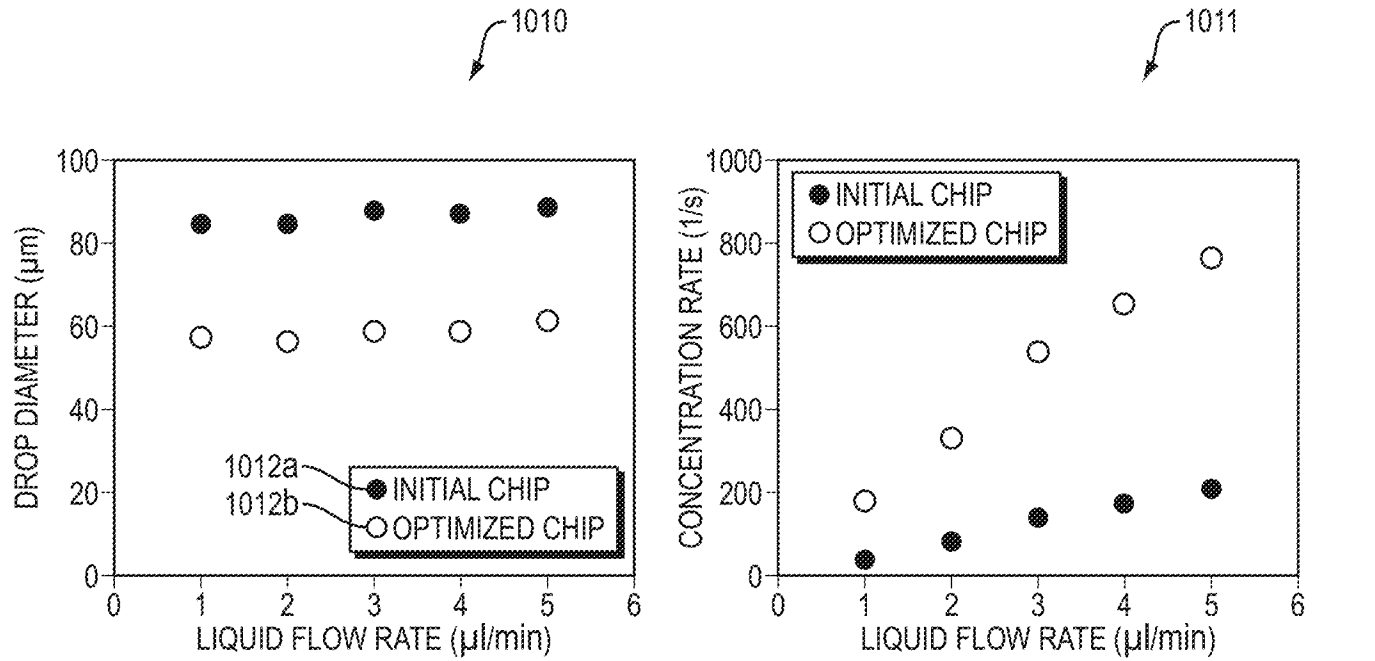
FIG. 10 are plots illustrating droplet generation performance for two different droplet generation regimes used in embodiments.

In addition to tuning properties of the gas and liquid flows, embodiments may also modify the structure of a generator structure to achieve desired droplet creation. For instance, modifications to the size and configuration of microchannels in a generator structure can be used to enhance performance metrics of the droplet-based system. It is feasible to manipulate the microchannel geometry to produce smaller, yet monodisperse droplets, at higher rates. FIG. 10 depicts droplet diameter vs. liquid flow rate in the plot 1010 and droplet generation rate versus liquid flow rate in the plot 1011 for an original generator structure 1012*a* and a modified generator structure 1012*b*. The modified generator structure 1012*b* has a smaller flow-focusing junction and microchannel outlet as compared to the junction and outlet of the original generator structure 1012*a*. It can be seen in the plot 1010 that droplet sizes are significantly reduced through changing the structure of the generation structure. This change in droplet size also results in an increased rate of generation (shown by the plot 1011) up to the kilohertz range. Droplets with an average diameter between 50 μm to 120 μm and a standard deviation of less than 5 μm can be obtained using the dripping regime. The linear trend of the generation rate shown in the plot 1011 illustrates that liquid flow rate plays the major role in the frequency of droplet generation. Also apparent is the lack of dependence of droplet size on the liquid flow rate.

Figure 11:
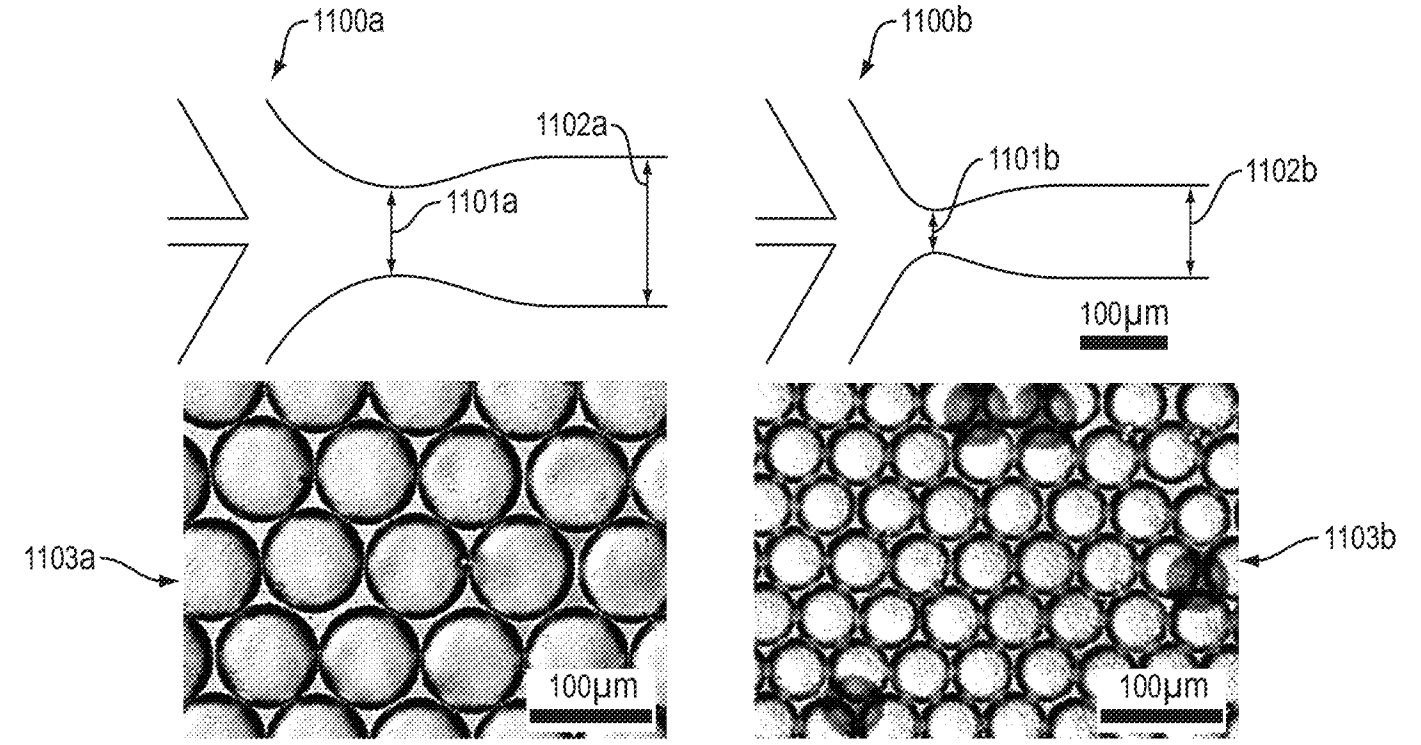
FIG. 11 is a diagram that depicts two different channel embodiments of the generator structure and resulting droplets created by the different channels.

FIG. 11 illustrates channels of a generator structure 1100*a* and a modified generator structure 1100*b*. The original structure 1100*a* has a wider flow-focusing junction 1101*a* and a wider, 180 μm, outlet 1102*a*. In comparison, the modified structure 1100*b* has a narrower junction 1101*b* and a narrower, 120 μm, outlet 1102*b*. Shrinking the junction 1101*b* and the outlet 1102*b* results in generating smaller droplets and, consequently, increasing the generation rate for the same flow input. The microscopic images 1103*a* and 1103*b* are show droplets created using the structures 1100*a* and 1100*b*, respectively. The images 1103*a* and 1103*b* show that by reducing the size of the junction 1101*b* and the microchannel outlet 1102*b*, the modified generator structure

1100*b* is capable of generating smaller droplets while maintaining droplet monodispersity.

In an embodiment, the flow in a manipulator structure is divided into a main flow ($Q_{main}$) aimed at removing the carrier oil from the middle channels (i.e., channels between the support columns) of the manipulator structure and two side flows ($Q_{harvesting}$) for harvesting the droplets. Therefore, in such an embodiment, at the same time that droplets enter the manipulator structure, the carrier liquid is also drawn into the extraction section and the carrier liquid travels toward the downstream microfilter. Simultaneously, the side harvesting flows direct chains of droplets to enter in an orderly fashion into the microchannels defined by the manipulator structure. Both the main channel flow rate and microchannel flow rate can be tuned in a cross-flow filtration scheme in order to extract the maximum number of droplets from the collection chamber and harvest the majority of droplets into the microchannels for processing.

Figure 12:
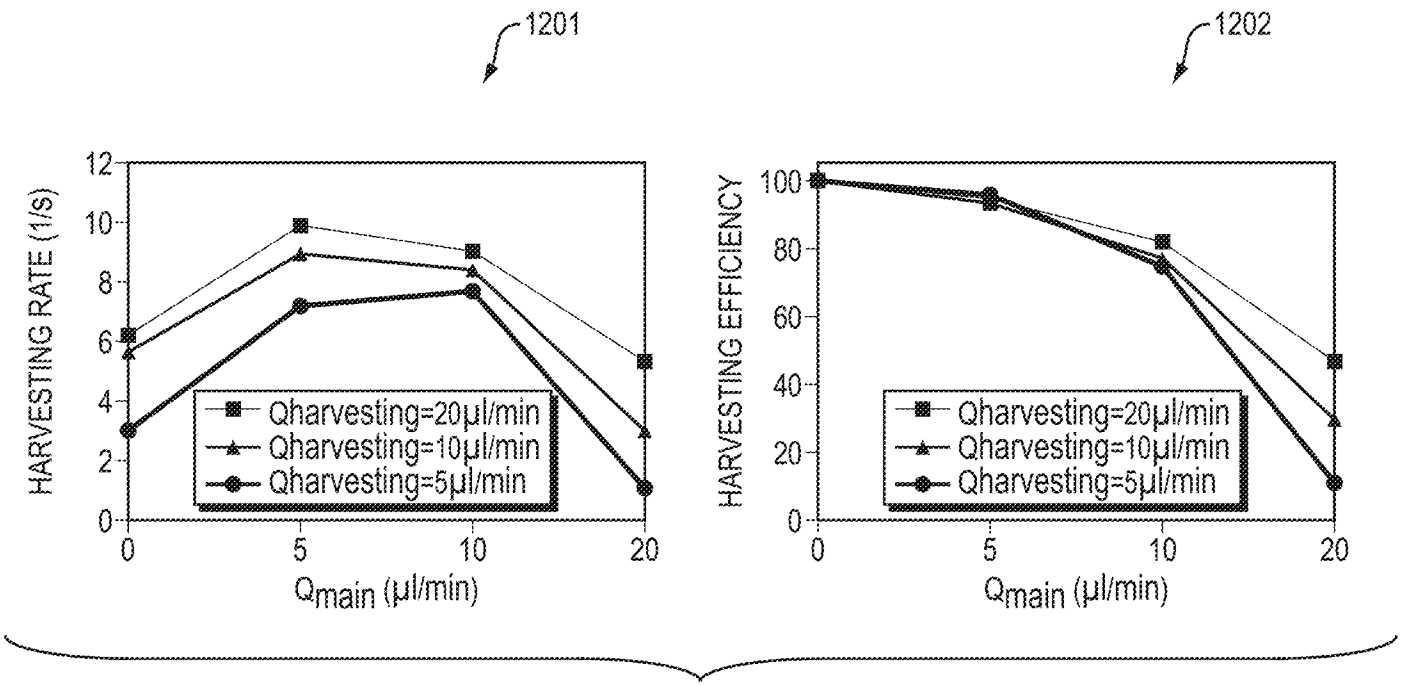
FIG. 12 is a pair of plots that illustrates experimental data of the harvesting rate and harvesting efficiency of the manipulator structure.

The plot 1201 in FIG. 12 depicts the performance of harvesting rate (number of harvested droplets) for various flow rates of the main channel and harvesting microchannels. The plot 1202 depicts harvesting efficiency, which is defined as the ratio of the number of droplets moved into the harvesting microchannels to the total number of droplets that enter the extraction section of the manipulator structure for various main flow rates. By increasing the main flow rate more droplets are removed from the collection chamber and into the manipulator structure. As a consequence, because more droplets are present in the extraction section of the manipulator structure, one may expect to have an increased number of droplets being harvested in the microchannels. However, there is the possibility that more droplets would bypass the harvesting microchannels and accumulate in the center portion of the main extraction section. Furthermore, at even higher flow rates, some of the droplets bypass the microfilter. The plots 1201 and 1202 show a tradeoff for main flow rate ($Q_{main}$) versus harvesting efficiency and likewise, represent an optimal point for collecting the maximum number of droplets for a given value of harvesting efficiency, $Q_{harvesting}$. In this optimum region, the droplets that enter the extraction section move closely to each other and the majority of the droplets are directed toward the harvesting channels. By increasing $Q_{harvesting}$ one can expect to improve the droplet harvesting. It should be noted that at high values of $Q_{harvesting}$, the droplets will no longer travel close to each other in a chain format and a significant amount of carrier oil also enters the microchannels. Thus, for the most efficient performance in terms of the quantity of droplets extracted and also the quality of the droplets harvested into the microchannels, extraction must be performed in a certain flow rate range. Thus, the plot 1201 shows that harvesting rate decreases significantly when $Q_{main}$ is 20 μl/min. Likewise, the plot 1202 shows that harvesting efficiency drops as $Q_{main}$ increases. Therefore, in operation, $Q_{main}$ can be varied to achieve a desired harvesting rate and efficiency.

As described herein, embodiments may generate droplets of liquid through convergence of gas and air at a junction of microchannels. In one such embodiment, this generation is performed by dripping, where the droplets "drip" from the liquid entering the liquid channel.

Figure 13:
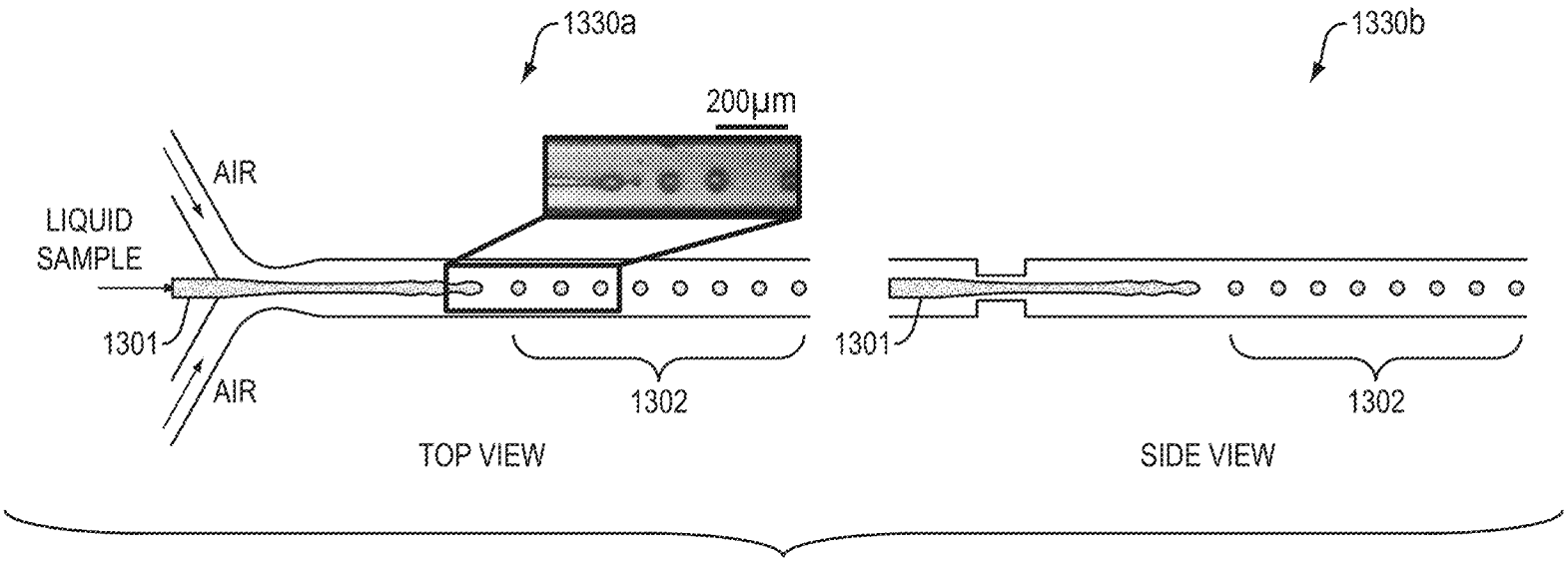
FIG. 13 is a diagram that graphically depicts a liquid droplet generation regime that may be employed in embodiments.

In contrast, in another embodiment, a jetting regime is used that provides ultra-high-throughput generation of liquid microdroplets using a high-speed gas flow. FIG. 13 depicts a top view 1330*a* and a side view 1330*b* of a channel layout used for generating droplets via a jetting regime. In an embodiment, the procedure for droplet generation is performed in a compact lithography-based multi-layer microfluidic chip fabricated in PDMS. In the jetting regime, a thin liquid column 1301 is surrounded by a gaseous flow. The jetting regime provides ultra-fast break-up of the liquid jet 1301 into an array of microdroplets 1302. With the jetting regime it is possible to obtain 25 μm diameter droplets at much higher frequencies (f≈120 kHz) than existing microfluidic systems. Further, the chip based nature of the system provides a great opportunity for integrating the jetting regime module into more complex lab-on-a-chip devices. Therefore, the jetting regime droplet generation structure can be used for creating ultra-high-throughput and oil-free digitization platforms with potential applications in numerous healthcare and material applications. For instance, the jetting structure can be incorporated into platform embodiments, e.g., the platform 111, or the jetting structure can be used in entirely separate applications where generation of liquid droplets is needed.

The jetting regime provides ultra-fast breakup of droplets in the order of $10^5$ droplets/sec ejected from a single generator structure. Likewise, as with the other embodiments described herein, the functionality can be used in a compact and chip-based platform to provide controlled digitization of a liquid. Thus, the structure implementing the jetting regime enables droplet generation inside a confined microchannel within a gaseous flow. This jetting structure is also advantageous because its manufacturing can easily be scaled-up for mass production using parallel generation. Further, the jetting regime provides a method for oil-free generation of liquid microdroplets and allows for a flow-driven scheme for break-up of the liquid jet into an array of liquid droplets without the need for additional mechanisms that can add complexity. Further still, the platform can be integrated into complex microfluidic networks.

The jetting droplet generation regime has numerous uses. Amongst others, embodiments can be used in the pharmaceutical industry for the creation of aerosolized drug products, in the food industry for the mass production of dry powders, in the materials industry for high-speed direct assembly using a bottom-up approach with high-precision, and in diagnostic applications for digitization of liquid samples into discrete microreactors with high surface-area-to-volume ratios so as to improve sensitivity and reduce the limit of detection.

The jetting regime utilizes a generator structure that provides liquid-in-gas droplet formation in a non-planar, three-dimensional, flow-focusing microfluidic device. Existing methods have been used for generation of uniform aerosols in a microfluidic network in a planar flow-focused architecture.

Figure 14:
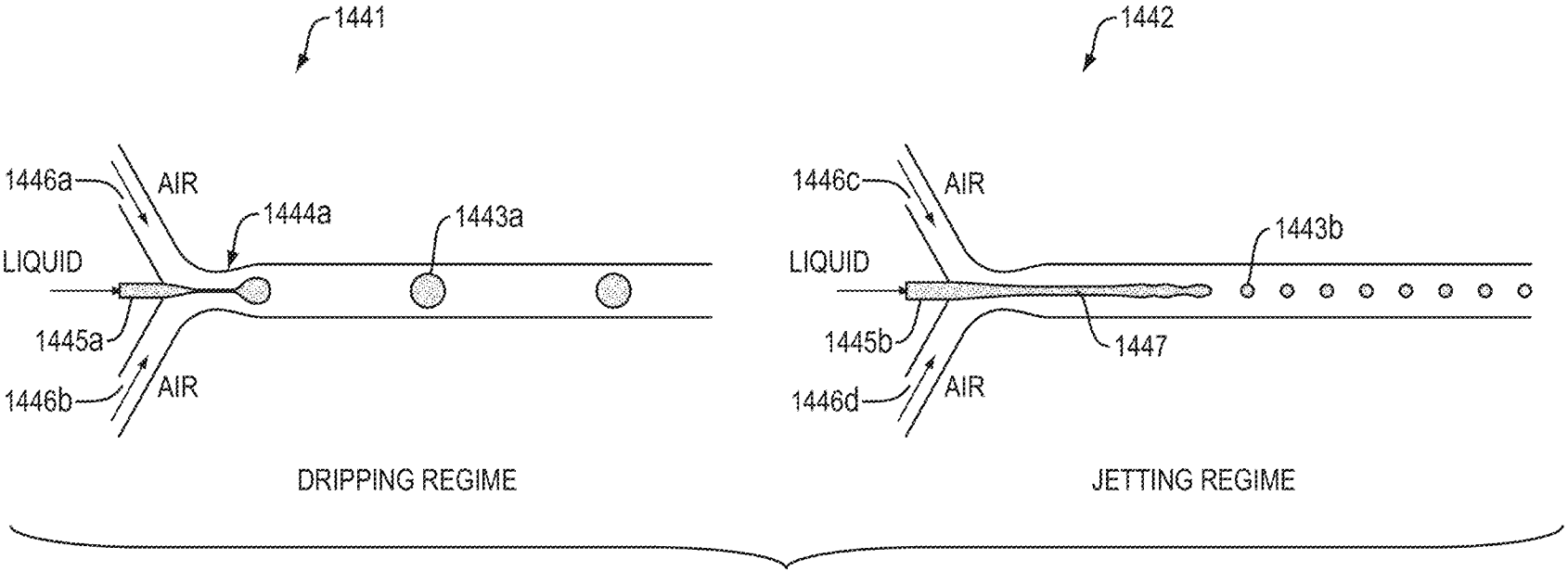
FIG. 14 is a diagram that graphically depicts two different droplet formation regimes that may be implemented in embodiments.

FIG. 14 shows top views of a schematic drawing of channels for a dripping regime structure 1441 and a jetting regime structure 1442. Droplet formation processing is achieved in the dripping regime 1441 which exhibits a limited frequency (<1 kHz) and size (>50 μm). In the dripping regime 1441 droplets 1443*a* are formed and detached intermittently in the flow-focusing junction 1444*a*. In the dripping configuration 1441, the high-speed gas flows 1446*a* and 1446*b* pinch off the droplets that are ejected from the liquid microchannel 1445*a* while passing across the junction 1444*a*.

To overcome the barriers of the dripping regime 1441, the jetting regime structure 1442 creates droplets from an extended liquid microjet 1447. In the jetting regime 1442, smaller droplets 1443*b* that are commensurate, i.e., approximately the same, as the diameter of the liquid microjet 1447 are produced at higher frequencies compared to the dripping regime 1441. Establishing a liquid jet 1447 is difficult to accomplish when the liquid and the carrier gas travel in the same plane because of surface interactions inside planar microfluidic devices. In order to overcome this hurdle, embodiments eliminate contact of the liquid 1447 with the microchannel walls and enable transition into the jetting regime by using a 3D flow-focusing microfluidic platform where the liquid channel 1445*b* has a smaller height as compared to the heights of the gas channels 1446*c* and 1446*d*. As a result, the continuous gas flow used in the liquid droplet structure for the jetting regime 1442 completely surrounds the jetted liquid stream 1447 and droplets 1443*b*. The jetting technique significantly improves formation performance of microfluidic droplet based systems and provides an order of magnitude increase in the generation frequency (f≈120 kHz) relative to existing methods.

In an embodiment, the generator structure for the jetting regime is fabricated using lithography techniques. FIG. 15A depicts a mold 1550 for creating the jetting generator structure. The process to fabricate the 3D microfluidic jetting structure begins with fabricating the master mold 1550. To create the mold 1550, photolithography processes are performed in three stages to create a multilayer structure on top of a silicon substrate. To begin, a photosensitive epoxy, such as SU-8 50 from MicroChem Corp., is used as the structural material and is spin coated over the substrate (50 μm for the first layer, and 30 μm for the second and third layers). In each stage, after spin coating the photoresist, a separate mask is used to expose different regions of the device so as to create features with different heights. The first layer contains a negative alignment hole 1551. In the second layer, the microchannels 1552*a*, 1552*b*, and 1553 are exposed through the mask. For the third layer, the air channels 1552*a* and 1552*b* and the outlet 1554 are exposed. After the third exposure, by developing the mold 1550 in the appropriate solution, the final mold 1550 containing smaller (height) liquid features (the channel 1553) and taller gas features (the channels 1552*a* and 1552*b*) is fabricated.

Figure 15B:
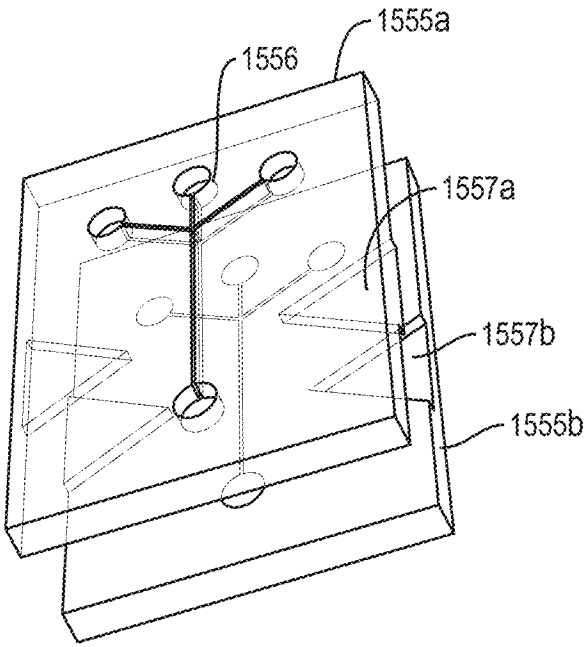
FIG. 15B is a diagram depicting two layers that form the generator structure according to an embodiment.
Figure 15A:
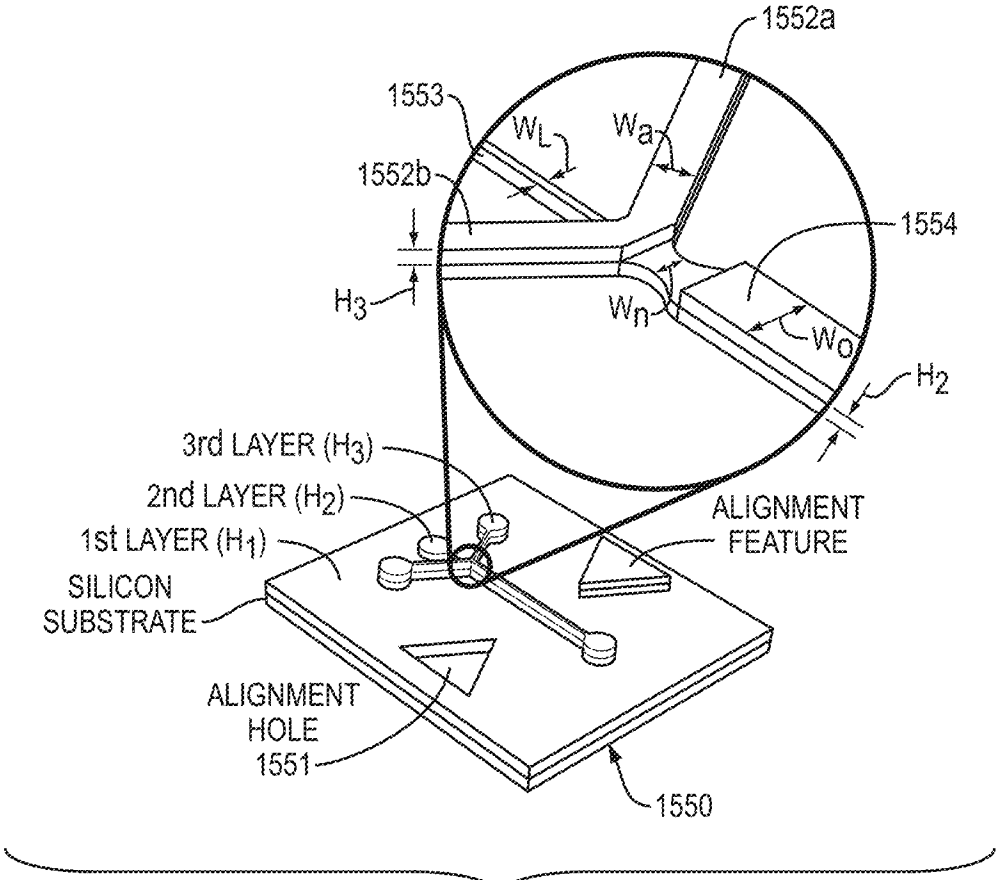
FIG. 15A is a diagram that depicts a mold for creating a generator structure used in an embodiment.

Using the mold 1550, microfluidic chips 1555*a* and 1555*b* depicted in FIG. 15B are fabricated using a soft lithography process with PDMS such as a Sylgard 184 silicone elastomer kit (Dow Corning Corp) with a mixture of base to curing agent ratio of 10:1 (w/w). To continue making the chips 1555*a* and 1555*b*, the solution is poured onto the silicon master mold 1550 and the assembly is placed in a vacuum chamber for air bubble removal. The mold 1550 is then placed on a hot plate on 80° C. for 2 hours and the cured solution is peeled from the mold 1550. The mold 1550 is replicated once more to create the complementary half of the microfluidic chips. The two PDMS pieces 1555*a* and 1555*b* contain the same microchannel geometry 1556 but, complementary alignment marks-one positive and one negative (e.g., the symmetric triangular marks 1557*a* and 1557*b*) when placed face-to-face. After replication, the microfluidic chips 1555*a* and 1555*b* are exposed to a plasma cleaner for bonding. Proper alignment of the two PDMS replicas 1555*a* and 1555*b* is necessary for centering the liquid jet and having a centered liquid jet plays a crucial role in the performance of the generator structure. Therefore, to facilitate the bonding, a drop of deionized water is placed between the two PDMS layers 1555*a* and 1555*b*, as a lubrication layer to prevent the instant bonding of the pieces after plasma. The top layer is moved until the alignment marks, e.g., 1557*a* and 1557*b* match each other. As a result, the flow-focusing junctions become aligned. The device is then placed on a low-temperature hot plate (50° C.) until the water layer evaporates. The chips 1555*a* and 1555*b* are post-baked at a higher temperature (200° C. for 4 hrs.) to improve bonding strength. The jetting generator structure advantageously does not require any chemical coatings on the microchannel walls for droplet generation because the 3D structure enables generation of liquid droplets that are completely surrounded by an air cushion inside the microchannel. This attribute significantly improves the life-time of each jetting generator structure as compared to a "2D" microfluidic channel, i.e., a device where the air and fluid channels are the same height. Further, the jetting structure is more resilient for certain applications because the jetting structure does not utilize any glass.

Figure 16:
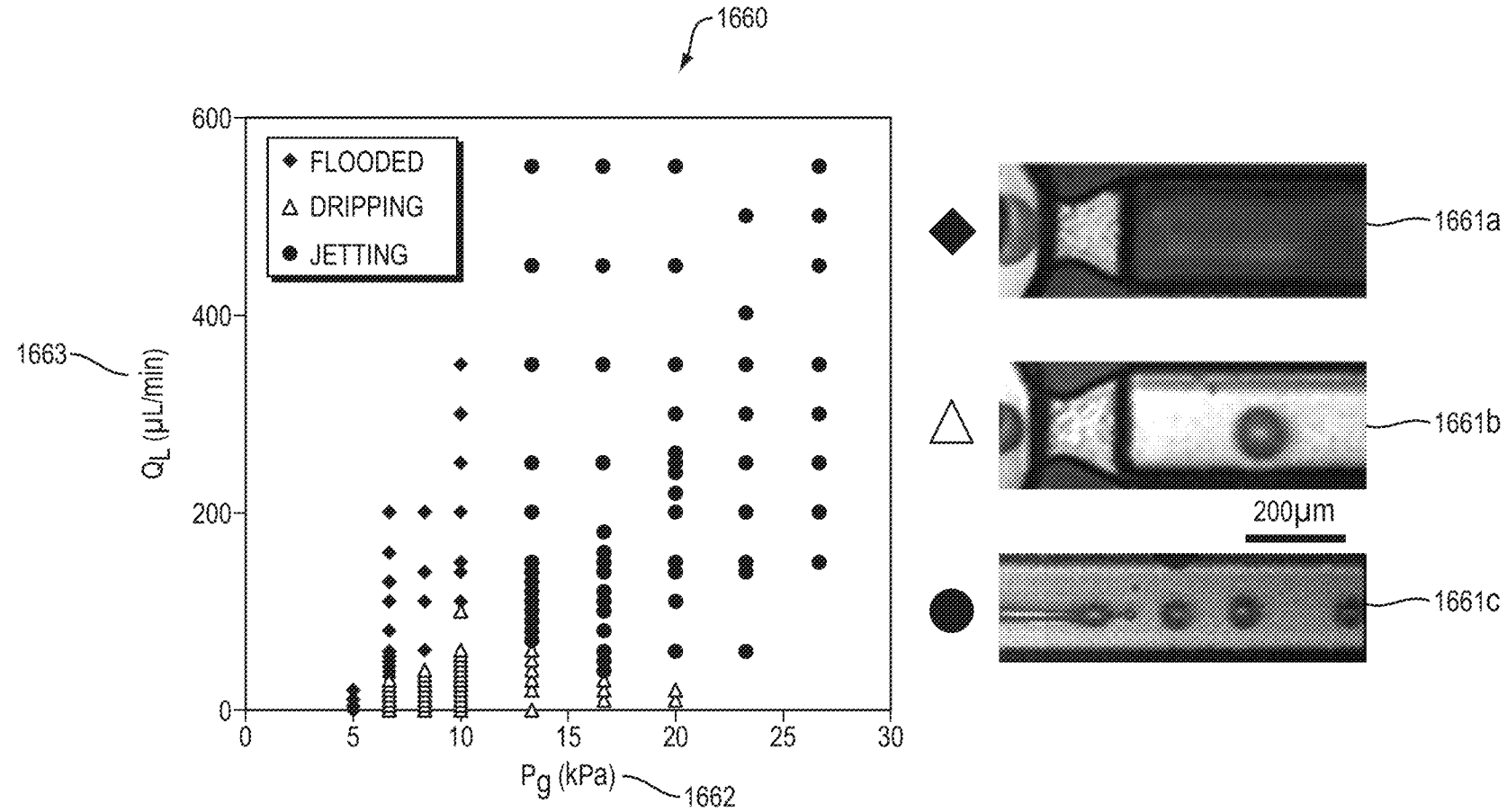
FIG. 16 is a flow map showing results of droplet formation for varying droplet formation regimes.

To evaluate the jetting regime structure during operation, an evaluation was done by applying a constant gas pressure ($P_g$) across the flow-focusing junction of the device and a constant liquid flow ($Q_L$) was subsequently injected into the microchannel. FIG. 16 shows in the plot 1660 the regions where the dripping regime 1661*b* and jetting regime 1661*c* were observed inside the microchannel for different applied gas pressures 1662 and liquid flow rates 1663. Due to the confinement of the microchannels, a third condition was observed in which liquid flow flooded 1661*a* the outlet of the generator structure and no droplet formation was achieved. In the flooding scenario, because the liquid cap, i.e., the tip of the liquid which is the hemispherical liquid interface that is formed at the liquid inlet behind the flow focusing junction, is bigger than the height of the channel, as the cap grows, it touches the top and bottom walls of the channel. As a result, the channels become wet and droplets are no longer formed in the outlet of the generator structure.

To further evaluate the jetting regime, the frequency of droplet formation was determined by counting the droplets in a specific time interval. Precise measurement of the droplet size inside the microchannel is difficult to determine due to the fast movement of droplets. However, average droplet diameter can be calculated as:

$$D = \sqrt[3]{\frac{6Q_L}{\pi f}} \tag{1}$$

Where $Q_L$ represents the liquid flow rate and f is the measured generation frequency through manual counting of the generated droplets. Droplet size behavior as a function of flow conditions was also validated experimentally from the still images and was in good agreement for the range of the tested liquid flow rates and gas pressures.

Figure 17:
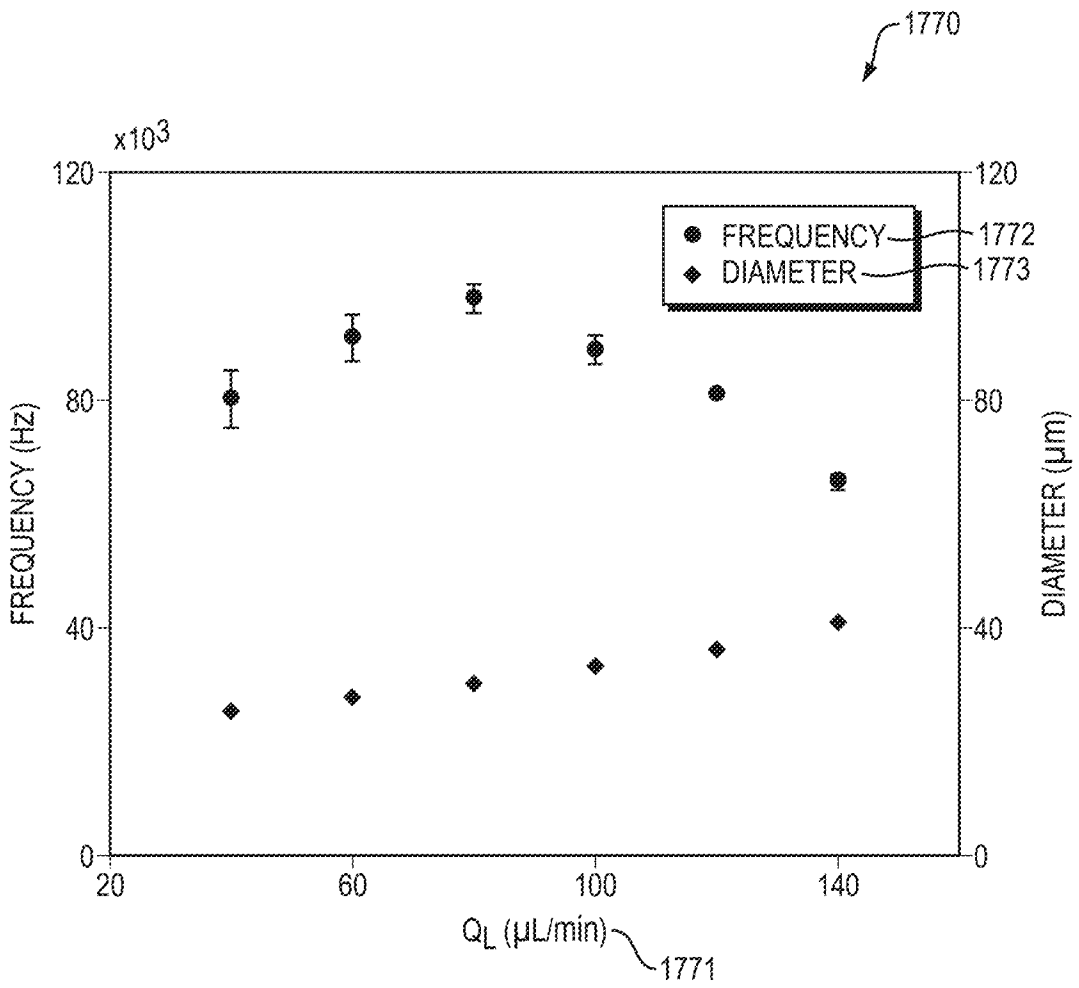
FIG. 17 is a plot depicting results for droplet generation frequency and generated droplet size for varying liquid flow rates.

The plot 1770 in FIG. 17 illustrates the effect that liquid flow rate 1771 has on the formation rate 1772 and droplet size 1773 at constant gas pressure (20 kPa). Frequency increase is observed at early stages of the jetting regime for lower liquid flows. However, increasing the liquid flow rate in the jetting regime also creates a jet with bigger diameter. Thus, the corresponding droplets that detach from the jet become bigger in size. The frequency of the generation 1772 is reduced at higher liquid flow rates (e.g. 100 μL/min) since the effect of the increased droplet volume becomes more prominent in comparison to the increase in the liquid flow rate (See Equation 1).

Figure 18:
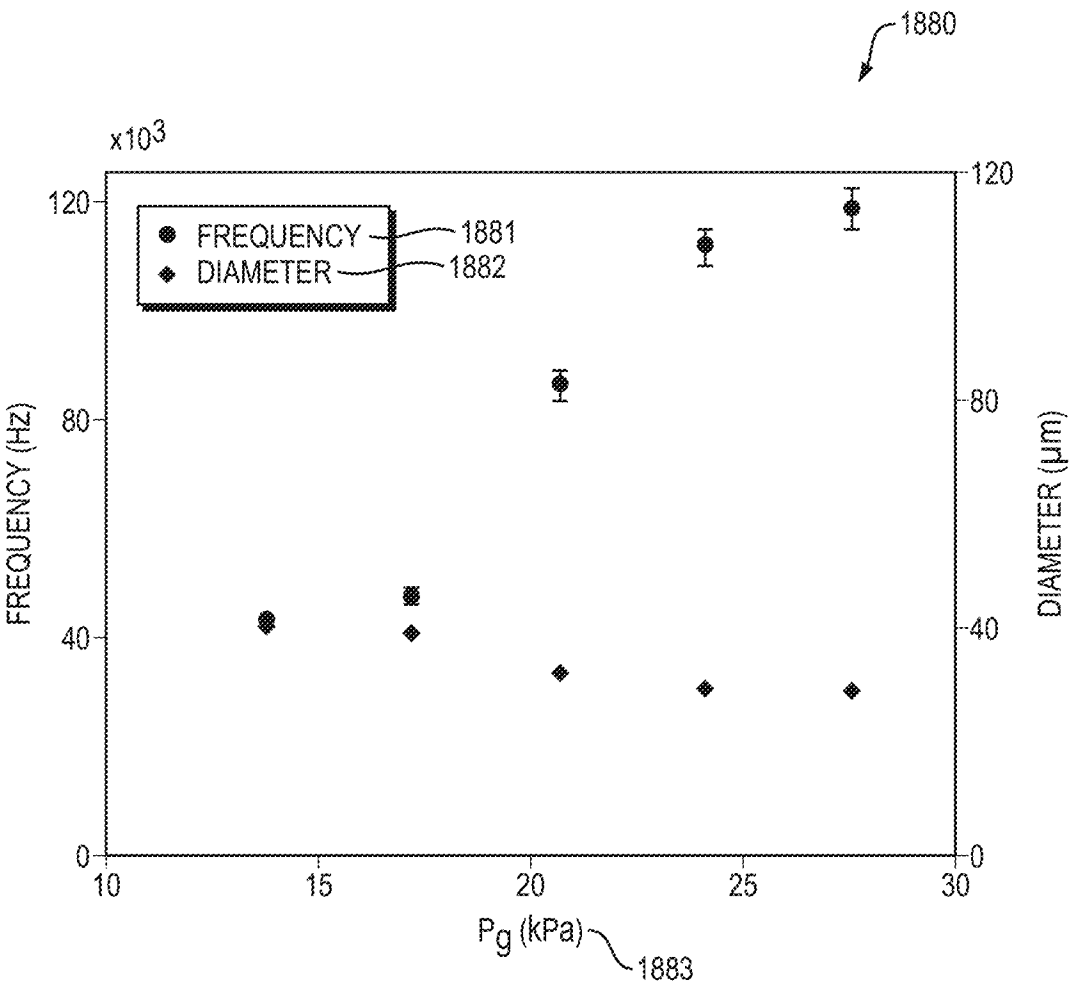
FIG. 18 is a plot illustrating results for generation frequency and generated droplet size for varying applied gas pressures.

The plot 1880 in FIG. 18 shows the results of droplet formation frequency 1881 and size 1882 as gas pressure 1883 is increased and the liquid flow rate is kept constant at 100 μL/min. The continuous gaseous phase has an opposite effect compared to liquid flow rate on the droplet size and generation frequency (shown in FIG. 17). By maintaining a constant liquid flow rate, the plot 1880 illustrates that increasing the gas pressure results in forming a thinner liquid jet from which smaller drops can be obtained. Generation frequency 1881 shows a consistent increase with increasing the applied gas pressure 1883 in the microchannel, and droplet diameter 1882 decreases. In the range of the tested flow conditions for the jetting regime, is possible to obtain 25 μm droplets and generation frequencies up to 120 kHz. These values, however, can be further optimized by modifying the geometry of the microchannel as well as flow parameters of the system. This order-of-magnitude increase in the formation rate shows the potential impact to liquid-gas droplet microfluidics provided by the jetting structure for next-generation fluidic systems. By using the jetting structure these next generation systems are suitable for a variety of technologies that benefit from high throughput digitization of fluid samples. Thus, jetting structure embodiments described herein can be used in embodiments of platform described herein or, alternatively, can be used separately, or an in variety of applications where high throughput digitization of fluids is desired.

Figure 19:
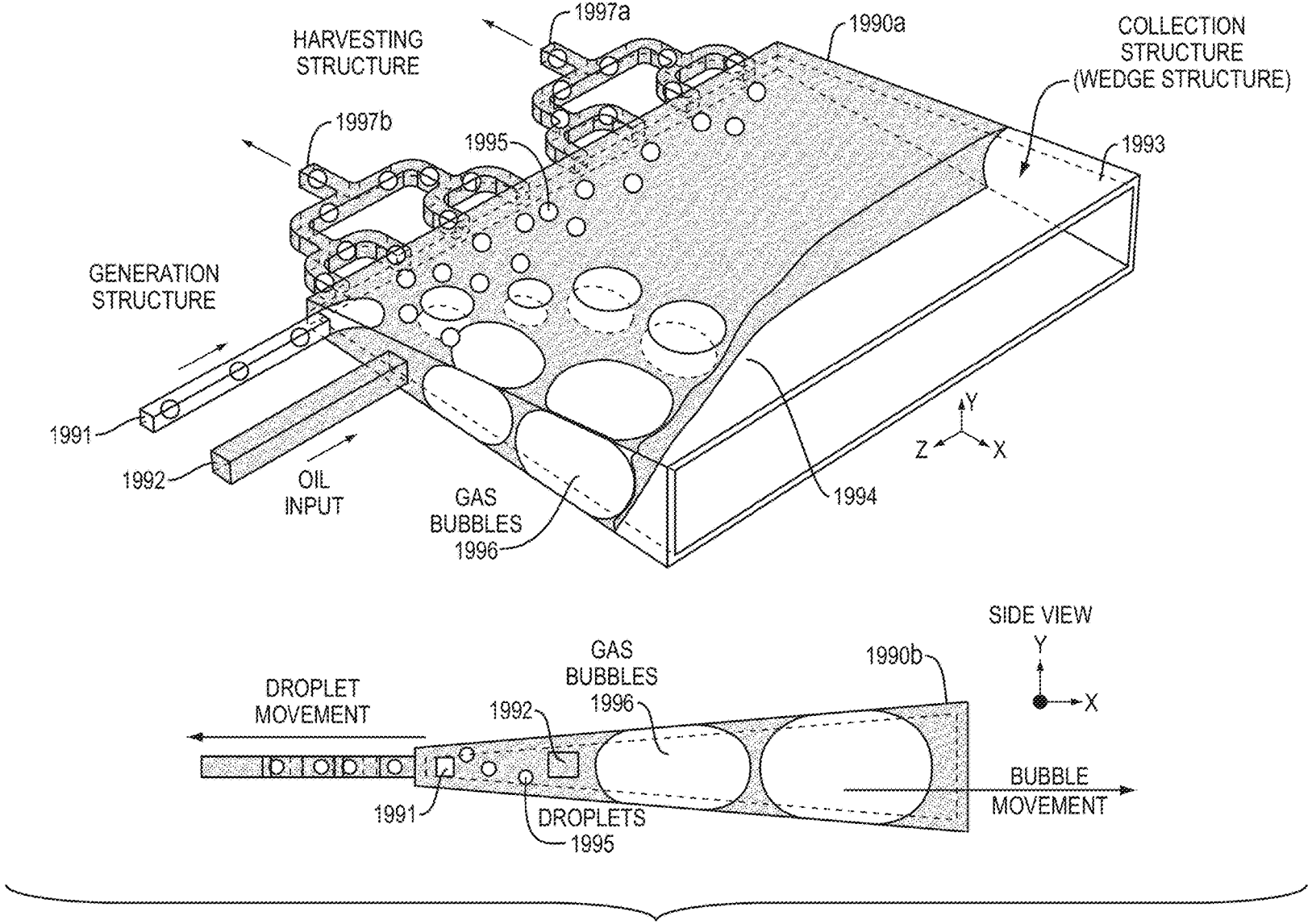
FIG. 19 is a graphical depiction of a liquid droplet collection device according to an embodiment.

FIG. 19 is an isometric view 1990*a* and a side view 1990*b* of an alternative collection structure (generally referenced as 1990) for liquid droplet collection and manipulation. The structure 1990 can be used in conjunction with the generation and manipulator structures described herein to generate, collect, and harvest liquid droplets. Alternatively, the structure 1990 can be employed in any application liquid droplet collection is needed.

Airborne target sampling and digitization platforms employ a gravity based collection structure. The collection structure includes a centimeter sized cubic reservoir filled with oil. The exit of the generator structure is placed at the top of the oil reservoir while the inlet of the harvesting structure is at the bottom. As the gas-liquid droplet mixture enters the oil reservoir, the net gravitational force acting on the droplets pulls the droplets downward, while the net buoyancy force acting on the gas, forces the gas to rise and escape the reservoir through the oil-air interface. Such a structure however, and the underlying scheme, are not feasible for operation in low gravitational field applications, such as those encountered during space travel.

In contrast, the structure 1990 employs capillary forces to separate the gaseous phase 1996 from the oil phase and liquid droplets 1995. The collection structure 1990 includes the droplet inlet 1991 that can be coupled to a generator structure and an oil/carrier fluid inlet 1992 that connects to an oil/carrier fluid source. Further, the collection structure 1990 includes outlets 1997*a* and 1997*b* that connect to a manipulator structure, such as those described herein. The collection structure 1990 defines a wedge section 1993 with a micrometer-sized height of varying dimension. The varying internal height of the wedge 1993 leads to an imbalance of surface tension forces for gas bubbles 1996 and liquid plugs/droplets 1995 within the wedge 1993. In operation, the gas bubbles 1996 move towards the section of the wedge with a larger height dimension and the liquid plugs 1995 move towards the section of the wedge 1993 with a smaller height dimension or vice-versa depending on whether the wedge 1993 surfaces are hydrophilic or hydrophobic, respectively. A hydrophilic wedge is more desirable than a hydrophobic one since the hydrophilic wedge is better for the higher volume gas phase to move towards a wider section exit aperture rather than a narrow one. The structure 1990 functions based on capillary, rather than gravitational forces.

Further, the collection structure 1990 can be constructed from any appropriate material, such as PDMS, which is slightly hydrophobic or Poly(methyl methacrylate) (PMMA), which is hydrophilic in nature. It is also possible to coat or treat surfaces of the structure 1990 to make the surfaces in the wedge collection chamber 1993 hydrophilic. Further, it is noted that while the wedge structure 1993 is depicted, embodiments are not so limited and different geometries and wedge profiles can be used to optimize the separation of the gas phase 1996 and the extraction of the liquid droplets 1995.

While this invention has been particularly shown and described with references to example embodiments thereof, it will be understood by those skilled in the art that various changes in form and details may be made therein without departing from the scope of the invention encompassed by the appended claims.

What is claimed is:

1. A platform for liquid droplet formation and isolation, the platform comprising:

a generator structure, a fluid-exchange structure, and a manipulator structure each defining a respective portion of a collection chamber, the generator, fluid-exchange, and manipulator structures vertically aligned on a substrate to form the collection chamber;

the generator structure configured to form liquid droplets from a stream of liquid received at a generator inlet and provide the liquid droplets to the fluid-exchange structure;

the fluid-exchange structure connected to the generator structure to receive the liquid droplets, in a carrier liquid held in the collection chamber, the fluid-exchange structure further connected to the manipulator structure to provide the carrier liquid with the liquid droplets via a fluid-exchange outlet;

the manipulator structure connected to the fluid-exchange outlet to receive the liquid droplets in the carrier liquid via a manipulator inlet, the manipulator structure defining a manipulator chamber connected to the manipulator inlet and having a first outlet and a second outlet, the defined manipulator chamber including a filter capable of filtering the liquid droplets from the carrier liquid, wherein the first outlet enables removal of the liquid droplets filtered from the carrier liquid and the second outlet enables removal of the carrier liquid filtered.

2. The platform of claim 1 wherein the generator structure defines:

a middle liquid channel arranged to allow the stream of liquid to flow into the generator structure; and a first and a second gas channel each on a respective side of the middle liquid channel, wherein the middle liquid channel and the first and second gas channels converge at a junction within the generator structure.

3. The platform of claim 2 wherein the generator structure is configured to form the liquid droplets by dripping, the dripping resulting from convergence of the stream of liquid from the middle liquid channel and gas streams from the first and second gas channels.

4. The platform of claim 3 wherein the dripping occurs at the junction where the middle liquid channel and the first and second gas channels converge.

5. The platform of claim 3 wherein the gas streams are air streams.

6. The platform of claim 2 wherein the stream of liquid enters the middle liquid channel as a jetted liquid stream.

7. The platform of claim 6 wherein a diameter of the liquid droplets formed by the generator structure is approximately the same as a diameter of the jetted liquid stream.

8. The platform of claim 2 wherein the middle liquid channel has a smaller height dimension than height dimensions of both the first and second gas channels to enable surrounding the stream of liquid with gas from the first and second gas channels.

9. The platform of claim 1 wherein the generator structure, fluid-exchange structure, and manipulator structure form an integrated platform on the substrate.

10. The platform of claim 9 wherein the integrated platform further includes a glass slide bonded to a bottom surface of the generator structure, and wherein:

the manipulator structure is disposed on the substrate;

a bottom surface of the glass slide is bonded to a top surface of the manipulator structure; and a bottom surface of the fluid-exchange structure is bonded to a top surface of the generator structure.

11. The platform of claim 1 wherein the carrier liquid is immiscible.

12. The platform of claim 1 wherein the carrier liquid is oil.

13. The platform of claim 1 wherein a wall of the fluid-exchange structure defines a gas venting outlet at a portion of the collection chamber.

14. The platform of claim 1 wherein the generator structure is composed of:

a Polydimethylsiloxane (PDMS) layer that defines a middle liquid channel and first and second gas channels on each side of the middle liquid channel; and a glass slide bonded to the PDMS layer to form a confined microchannel layout.

15. The platform of claim 1 wherein the manipulator chamber includes one or more columns between a top interior surface of the manipulator chamber and a bottom interior surface of the manipulator chamber.

16. The platform of claim 1 wherein the manipulator chamber further defines first and second side channels that connect to the first outlet.

17. The platform of claim 1 wherein the first and second outlets of the manipulator structure are configured to accept respective syringes for collecting the liquid droplets filtered from the carrier liquid and the carrier fluid filtered.

18. An apparatus for liquid droplet formation and isolation, the apparatus comprising:

means for forming liquid droplets from a stream of liquid;

means for receiving the liquid droplets from the means for forming the liquid droplets and for storing the liquid droplets in a carrier liquid; and means for receiving the liquid droplets in the carrier liquid and for filtering and enabling removal of the liquid droplets filtered from the carrier liquid and for enabling removal of the carrier liquid filtered.

19. The apparatus of claim 18 wherein the means for forming liquid droplets defines:

a middle liquid channel arranged to allow the stream of liquid to flow into the means for forming liquid droplets; and a first and a second gas channel each on a respective side of the middle liquid channel, wherein the middle liquid channel and the first and second gas channels converge at a junction within the means for forming the liquid droplets.

20. The apparatus of claim 19 wherein the middle liquid channel has a smaller height dimension than height dimensions of both the first and second gas channels to enable surrounding the stream of liquid with gas from the first and second gas channels.

21. The apparatus of claim 18 wherein the means for forming liquid droplets, the means for receiving the liquid droplets, and the means for receiving the liquid droplets in the carrier liquid form an integrated platform on a substrate.

* * * * *